US008104987B2

(12) United States Patent
Johnson

(10) Patent No.: US 8,104,987 B2
(45) Date of Patent: Jan. 31, 2012

(54) SELF-LOCATING ENGAGEMENT PIN LOCKING AND UNLOCKING APPARATUS

(75) Inventor: Noel R. Johnson, Stoughton, WI (US)

(73) Assignee: Johnson Health Tech Co. Ltd. (TW)

( * ) Notice: Subject to any disclaimer, the term of this patent is extended or adjusted under 35 U.S.C. 154(b) by 299 days.

(21) Appl. No.: 12/491,967

(22) Filed: Jun. 25, 2009

(65) Prior Publication Data

US 2010/0331153 A1 Dec. 30, 2010

(51) Int. Cl.
*F16B 7/10* (2006.01)

(52) U.S. Cl. ..... 403/104; 482/908

(58) Field of Classification Search ..... 403/103–107, 403/84, 90–95, 109.3, 109.8, 324–326, 96; 482/51–54, 57–62, 142, 94–103, 908
See application file for complete search history.

(56) References Cited

U.S. PATENT DOCUMENTS

| | | | | | |
|---|---|---|---|---|---|
| 1,989,810 | A | * | 2/1935 | Kregeloh | 248/88 |
| 2,488,305 | A | * | 11/1949 | Manger et al. | 292/275 |
| 2,855,199 | A | * | 10/1958 | Noland et al. | 482/97 |
| 3,439,672 | A | * | 4/1969 | Fisher | 602/16 |
| 4,529,219 | A | * | 7/1985 | Shamie | 280/642 |
| 4,602,890 | A | * | 7/1986 | Duda | 403/105 |
| 4,627,616 | A | * | 12/1986 | Kauffman | 482/96 |
| 4,811,945 | A | * | 3/1989 | Disbrow et al. | 482/63 |
| 5,265,969 | A | * | 11/1993 | Chuang | 403/94 |
| 5,277,684 | A | * | 1/1994 | Harris | 482/130 |
| D357,956 | S | * | 5/1995 | Hughes | D21/674 |
| 5,527,249 | A | * | 6/1996 | Harris | 482/96 |
| 5,554,085 | A | * | 9/1996 | Dalebout | 482/137 |
| 5,624,353 | A | * | 4/1997 | Naidus | 482/5 |
| 5,658,223 | A | * | 8/1997 | Habing et al. | 482/53 |
| 5,658,227 | A | * | 8/1997 | Stearns | 482/96 |
| 5,762,585 | A | * | 6/1998 | Jones et al. | 482/8 |
| 5,816,545 | A | * | 10/1998 | Malizia | 248/164 |
| 6,162,153 | A | * | 12/2000 | Perez et al. | 482/96 |
| 6,270,446 | B1 | * | 8/2001 | Abelbeck et al. | 482/57 |
| 6,290,630 | B1 | * | 9/2001 | Boland | 482/130 |
| 6,398,445 | B1 | * | 6/2002 | Matali Badia | 403/109.6 |
| 6,688,797 | B2 | * | 2/2004 | Park et al. | 403/93 |
| 6,932,749 | B2 | * | 8/2005 | Barnes et al. | 482/142 |
| 7,377,884 | B2 | * | 5/2008 | Schopf | 482/97 |
| 7,695,411 | B2 | * | 4/2010 | Pandozy | 482/62 |
| 2008/0096729 | A1 | * | 4/2008 | Hsu | 482/51 |
| 2010/0194156 | A1 | * | 8/2010 | Kim | 297/215.15 |
| 2010/0244408 | A1 | * | 9/2010 | Dean et al. | 280/647 |

* cited by examiner

*Primary Examiner* — Daniel Stodola
*Assistant Examiner* — Daniel Wiley
(74) *Attorney, Agent, or Firm* — Robert C Burck

(57) ABSTRACT

A locking and unlocking apparatus using an engagement pin with beveled surfaces designed to be inserted between two bodies. As the engagement pin is extended axially into a gap between the two bodies, it moves in a transverse direction to wedge tightly between the first and second body, locking them tightly together. When the engagement pin is retracted, the second body is able to move relative to the first body. A plurality of engagement surfaces placed into one of the bodies allows the mechanism to be locked into a plurality of set positions. These engagement surfaces on the first and second bodies also serve to locate the engagement pin when in the fully locked position, thereby reducing the need for tight tolerances.

22 Claims, 27 Drawing Sheets

SELF-LOCATING ENGAGEMENT PIN LOCKING AND UNLOCKING APPARATUS

FIELD OF THE INVENTION

The present invention relates to a locking and unlocking assembly, where two bodies which are partially constrained with respect to one another will become fully constrained when an engagement pin is fully engaged with the first body and the second body, such that there is substantially no movement between the two bodies when the engagement pin is fully engaged; and where the first body and second body are allowed to move with respect to one another when the engagement pin is disengaged from at least one of the two bodies. More particularly, the present invention relates to a locking and unlocking assembly using an engagement pin that is easy to produce, assemble, and use.

BACKGROUND OF THE INVENTION

Pull pin devices are known as a mechanism for locking two bodies together when the pull pin is extended, and for unlocking the two bodies when the pull pin is retracted. In a device of this type, the pull pin is constrained by a housing attached to a first body to move only in the axial direction. This pull pin is often spring-loaded to bias the pin in the extended position, where it extends into a hole or pocket in a second body, thereby positively locating the second body relative to the first body. When the pull pin is retracted from the hole or pocket in the second body, the second body is able to move relative to the first body. Often, the second body will have a plurality of holes or pockets, so that the second body can be positively located in any one of a plurality of set positions relative to the first body when the pull pin is extended, and can be moved between these set positions when the pull pin is retracted.

A typical use for a pull pin assembly is to adjust the height of one body relative to another. These devices are used quite heavily in the fitness industry. For instance, a padded seat used in a weight machine, such as a bicep curl machine, would typically be made adjustable to allow users of different heights to be seated at the correct height to allow them to interact with the weight machine in the proper ergonomic position. A typical seat height adjustment mechanism would have a padded seat attached to a telescopic tube mechanism, where a first, smaller diameter tube would be able to slide up and down inside a second, larger diameter tube. The first, smaller tube would typically have a plurality of holes punched or cut along its axis. The second, larger tube would have a pull pin assembly attached to it and be designed to have the pull pin aligned with the holes in the smaller tube. Whenever the pull pin would be retracted, the first, smaller tube would be able to slide up and down inside the second, larger tube, allowing the padded seat to be raised or lowered to the desired height. To lock the padded seat at a specific height, the pull pin would be extended into one of the plurality of holes in the smaller tube, thereby preventing the smaller tube from moving relative to the larger tube.

However, because this pull pin design requires certain manufacturing tolerances to ensure that all of the moving components can move smoothly with respect to one another (for instance, the pin has to be able to align with each of the plurality of holes; the holes need to be large enough in diameter to always accept the pull pin; the inner tube has to be smaller than the inner diameter of the larger tube to allow the smaller tube to slide within the larger tube, etc.) these tolerances will often add up to allow some motion between the multiple components, even when the pull-pin is engaged in the "locked" position. This relative motion in the nominally "locked" position will often impact the feel of the machine in an undesirable way (machine has unstable, sloppy, loose, or wobbly feel), and could even cause injury to a user in certain circumstances, if the supposedly "locked" mechanism were to shift or wobble at the wrong time. To reduce this undesirable relative motion in the nominally "locked" position often requires the application of very tight manufacturing tolerances, which can greatly increase the cost and complexity of the apparatus. Additionally, tight tolerances can often make the moving components more difficult to move, thereby increasing the difficulty of use.

Tapered pull pins have sometimes been used to remove some of the undesirable motion in the system. By using a pull pin having a tapered end slidingly engaged with a first body, and having a second body with one or more receiving holes that are smaller than the largest diameter of the of the tapered pin, the tapered pin can be inserted into any one of the holes to lock the two components together. The tapered pull pin acts just like a normal pull pin in that it allows the two bodies to move with respect to one another when the pull pin is disengaged, and it locks the two bodies together when the pull pin is engaged with the receiving hole in the second body.

However, the tapered end of the pull pin allows the tapered pull pin to fill up some of the hole clearance, thereby reducing some of the undesirable relative motion between the two bodies. The leading end of the tapered pull pin easily goes into the small receiving hole at first, but as the pull pin moves axially into the receiving hole, the tapered end of the pull pin causes the cross section at the entrance of the receiving hole to increase until it fills the receiving hole. Therefore, using a tapered pull pin can remove the clearance due to differences in the diameter of the receiving hole and the diameter of the tapered pull pin. However, this does not remove all of the undesirable relative motion between the two bodies. The tapered pull pin itself must be tightly constrained by the first body to minimize tilting or rocking of the pull pin, which would allow motion between the first and second bodies. The axis of the tapered pull pin must be tightly constrained to align with the location of the one or more receiving holes, because any misalignment could allow motion between the first and second bodies. The angle of the taper is important too, because a long taper angle will require a very long throw (large amount of axial travel of the pin to fully engage the receiving hole) while a short taper angle can allow the tapered pull pin to back out in the axial direction, allowing even more motion between the first and second bodies. Therefore, while a tapered pull pin can reduce some of the stack-up of tolerances that allow relative motion between the two bodies, it cannot eliminate all of the stack-up of tolerances that allow relative motion between the two bodies.

Clamping mechanisms, such as cam locks, have often been used to either augment or replace pull-pin mechanisms. The clamping mechanism is used to clamp the two bodies together to reduce any relative motion between the two clamped bodies. But these mechanisms are often more expensive, require additional components, and are often more difficult to use. Because clamping forces can be quite high, clamping mechanisms typically have force amplifying components (such as a lever on a cam lock) that allow a user to apply the needed clamping force required to prevent motion between two bodies. However, these force amplifying components also can make it difficult for a user to judge when then have reached the optimum clamping force. Applying too little force can make it appear that two objects are clamped together tightly, but then allow the two bodies to dangerously slip during later use. Applying too much force can cause damage to the components. Additionally, the large clamping forces in turn create large frictional forces, often making it difficult for a user to lock or unlock the clamped components. Again, the addition of these mechanisms can greatly increase the cost and complexity of the apparatus.

There remains a need for a locking and unlocking apparatus which will securely lock two bodies together such that there is relatively little relative motion between the two bodies when the locking mechanism is engaged, while still offering the ease of use, reliability, cost advantages, and reduced complexity of a lower tolerance device.

SUMMARY OF THE INVENTION

It is therefore an object of the present invention to provide a locking and unlocking apparatus which substantially reduces or eliminates all relative motion or backlash of the locked components while being easy to use, cost effective to manufacture, uncomplicated and reliable.

The locking and unlocking apparatus of the present invention generally comprises a first body, a second body, and an engagement pin with beveled surfaces designed to be inserted between the two bodies. The first body has an engagement surface designed to mate with at least some of the beveled surfaces on the engagement pin. The second body is partially constrained relative to the first body, but has the ability to move in relation to the first body. The second body has a plurality of engagement surfaces arranged to substantially align with the engagement pin. The engagement pin has a longitudinal axis. When the engagement pin is retracted, the second body is able to move relative to the first body. As the engagement pin is extended in the axial direction, the beveled surfaces of the engagement pin come into contact with the engagement surface on the first body and one of the plurality of engagement surfaces on the second body, thereby wedging or locking the first body and the second body together. These engagement surfaces on the first and second bodies also serve to locate the engagement pin when in the fully locked position. By engaging the engagement pin with different engagement surfaces on the second body, the first body and the second body can be locked into a plurality of set positions.

In another version, the locking and unlocking apparatus comprises a frame, an engagement pin with beveled surfaces, a wedge block attached to the frame, and an engagement plate with a plurality of engagement surfaces. The engagement plate and frame are moveable with respect to one another. The wedge block has at least one inclined guide surface, and the engagement pin has one or more beveled surfaces slidingly engaged with the inclined guide surface of the wedge block. The engagement pin is axially movable along the guide surface such that the wedge block drives the engagement pin to move in a transverse direction as the engagement pin moves in the axial direction. The engagement plate has a plurality of engagement surfaces positioned to be substantially aligned with the engagement pin. The engagement plate is movable in relation to the frame when the engagement pin is retracted. The engagement plate can be locked into any one of a plurality of relative positions when the engagement pin is extended into one of the plurality of engagement surfaces, and the extended engagement pin tightly engages both the wedge block and one engagement surface on the engagement plate to substantially eliminate any relative motion between the engagement plate and the frame.

This summary is not meant to be exhaustive. Further features, aspects, and advantages of the present invention will become better understood with reference to the following description, accompanying drawings and appended claims.

DETAILED DESCRIPTION OF THE INVENTION

Figure 1A:
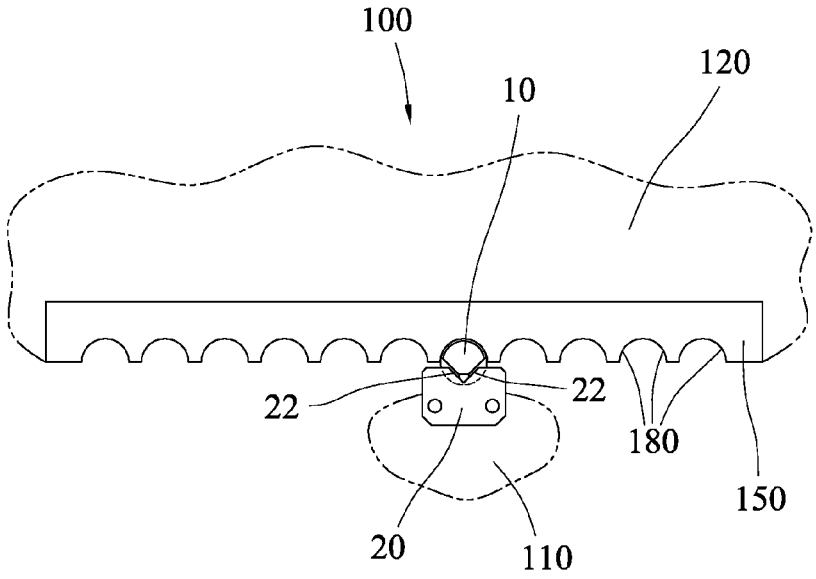
FIG. 1*a* is a front view of a locking assembly according to a first embodiment of the present invention.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

Figure 1B:
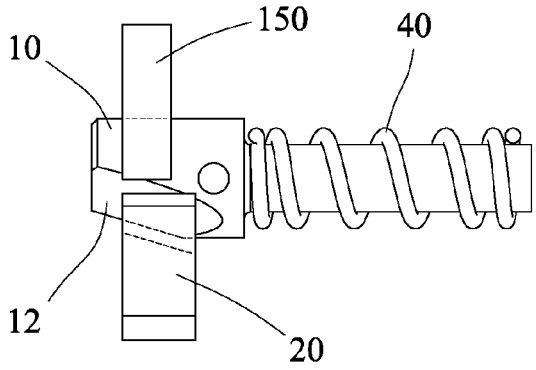
FIG. 1*b* is a side view of the locking assembly of FIG. 1*a*.
Figure 1C:
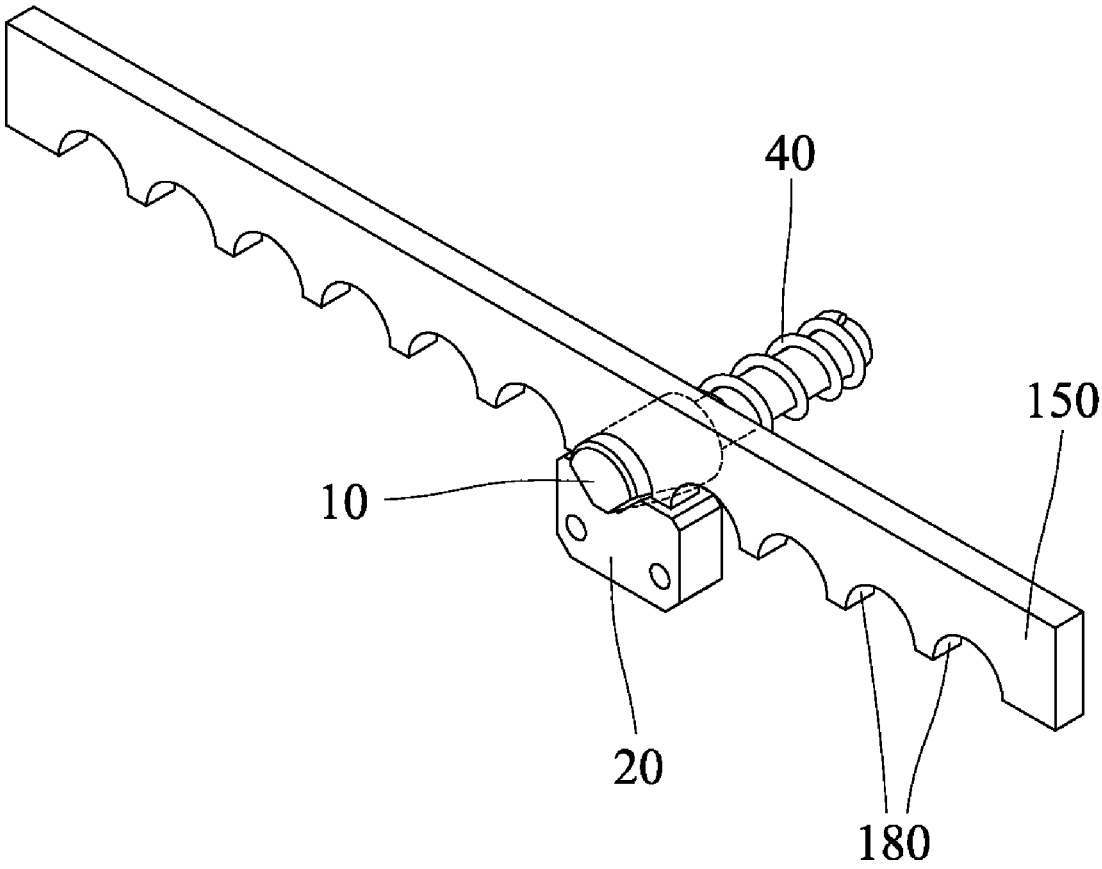
FIG. 1*c* is a perspective view of the locking assembly of FIG. 1*a*.

Referring to FIGS. 1*a*-1*c*, the present invention is a locking and unlocking apparatus 100 with an engagement pin 10 and a spring 40, a first body 110 including a wedge block 20, and a second body 120 including an engagement plate 150 with a plurality of engagement surfaces 180. The first body 110 and the second body 120 are linearly movable with respect to one another. It should be understood that this can mean that the first body 110 is stationary, while the second body 120 is movable with respect to the stationary first body 110, or it can mean that the second body 120 is stationary, while the first body 110 is movable with respect to the stationary second body 120. It can even mean that neither the first body 110 nor the second body 120 is truly stationary with respect to their surroundings.

The engagement pin 10 has one or more beveled surfaces 12, and the wedge block has one or more inclined guide surfaces 22 to interface with the beveled surfaces 12 of the engagement pin 10. As the engagement pin 10 travels in the axial direction, the inclined guide surfaces 22 of the wedge block 20 drive the engagement pin 10 in a transverse direction perpendicular to the axial direction.

When the engagement pin 10 is retracted in the axial direction so that it slides down the slope of the inclined guide surfaces 22, the engagement pin 10 moves away from the engagement plate 150. When the top surface of the engagement pin 10 does not contact any of the plurality of engagement surfaces 180 of the engagement plate 150, the first body 110 and the second body 120 are free to move with respect to one another.

When the engagement pin 10 is extended in the axial direction so that it is driven up the slope of the inclined guide surfaces 22, the engagement pin 10 moves upward toward the engagement plate 150. Even if there are large tolerances in the size and location of the engagement surfaces 180, the motion of the engagement pin 10 moving in the transverse direction perpendicular to the axial direction will close the gaps, allowing the engagement pin 10 to tightly wedge between the wedge block 20 and one particular engagement surface 180 on the engagement plate 150. When the top surface of the engagement pin 10 fully engages with the engagement surface 180, the first body 110 and the second body 120 are locked together, so that neither can move with respect to the other. Here, the engagement pin 10 is shown biased toward the extended position by a coil spring 40.

One major benefit of this design is that tight tolerances are not needed. Unlike a traditional pull pin mechanism, which requires a bushing or other tight housing around the pull pin to constrain it to move only in the axial direction, the present invention does not require tight tolerances, and actually works better when the engagement pin 10 can move in multiple directions (i.e. the engagement pin 10 needs to be able to move in the axial direction as well as at least one direction perpendicular to the axial direction). Also, the present invention is self locating. Therefore, not only will the engagement pin 10 close up relatively large gaps as it extends to fully engage the engagement plate 150, but the engagement pin 10 can be fairly drastically misaligned with the chosen engagement surface 180 while the engagement pin 10 is retracted, and yet it will still become fully aligned and tightly wedged into the proper location when the engagement pin is fully engaged.

Figure 2A:
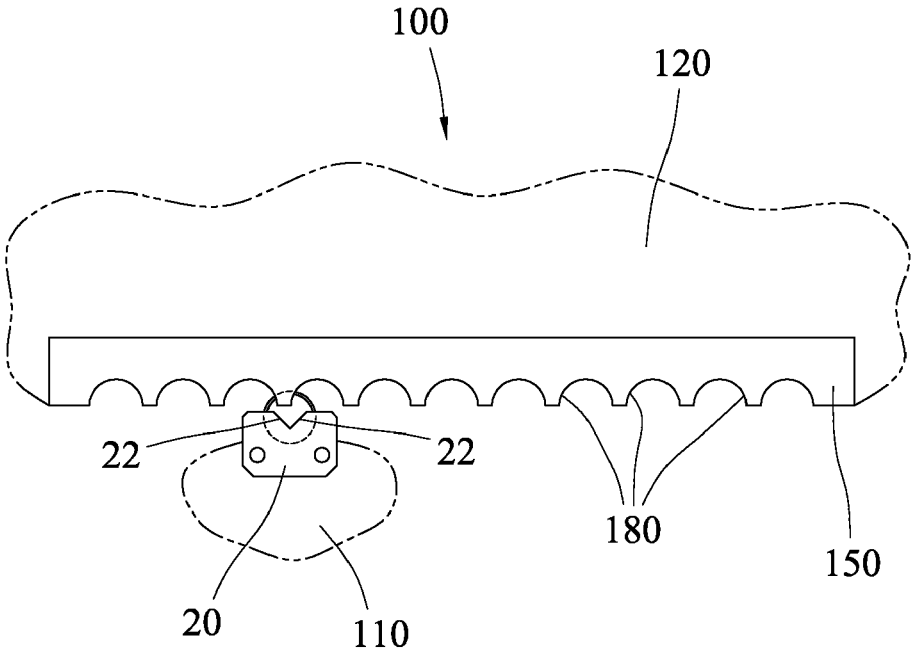
FIG. 2*a* is a front view of the locking assembly of FIG. 1*a*, with the engagement pin in the retracted position.
Figure 2B:
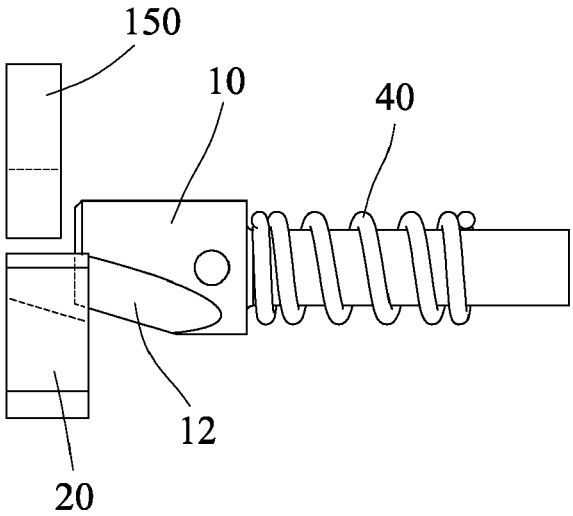
FIG. 2*b* is a side view of the locking assembly of FIG. 2*a*.
Figure 2C:
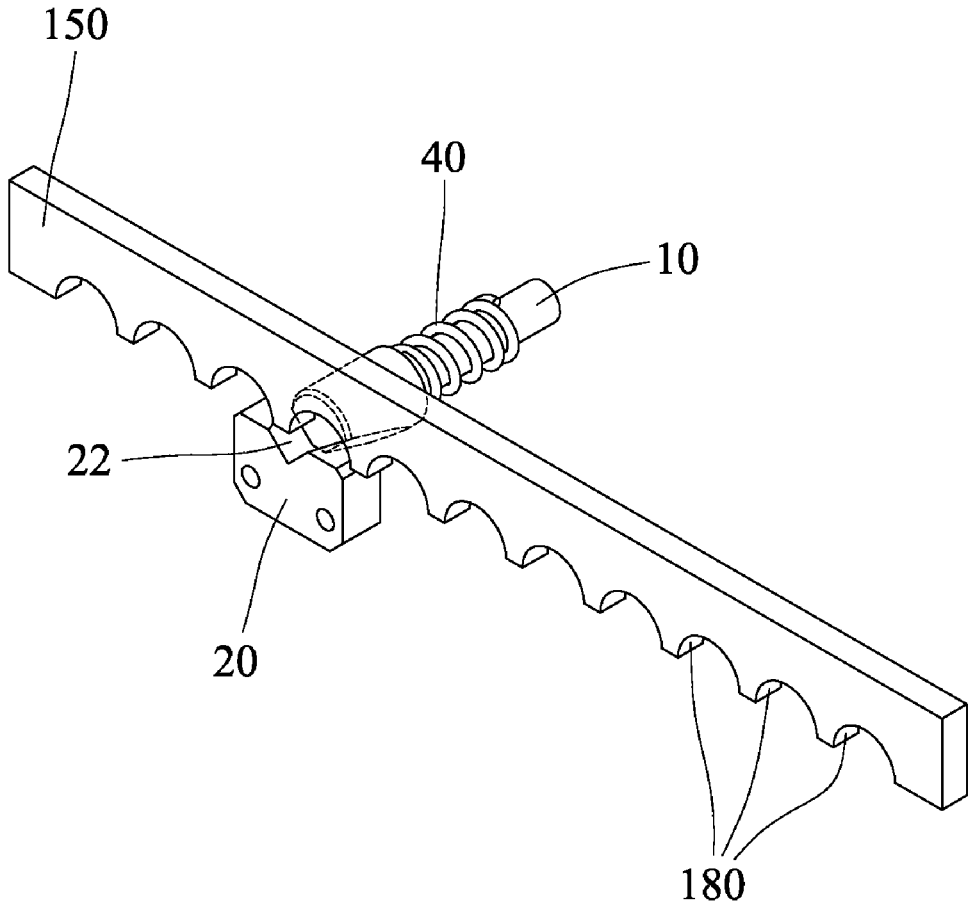
FIG. 2*c* is a perspective view of the locking assembly of FIG. 2*a*.

Referring to FIGS. 2*a*-2*c*, the engagement pin 10 has been retracted so that it no longer comes into contact with the engagement plate 150 or any of the engagement surfaces 180. With the engagement pin 10 retracted, the first body 110 and the second body 120 are now free to move with respect to one another. In FIGS. 2*a*-2*c*, it appears that the second body 120 has remained stationary, and the first body 110 is the component that has moved.

Figure 3A:
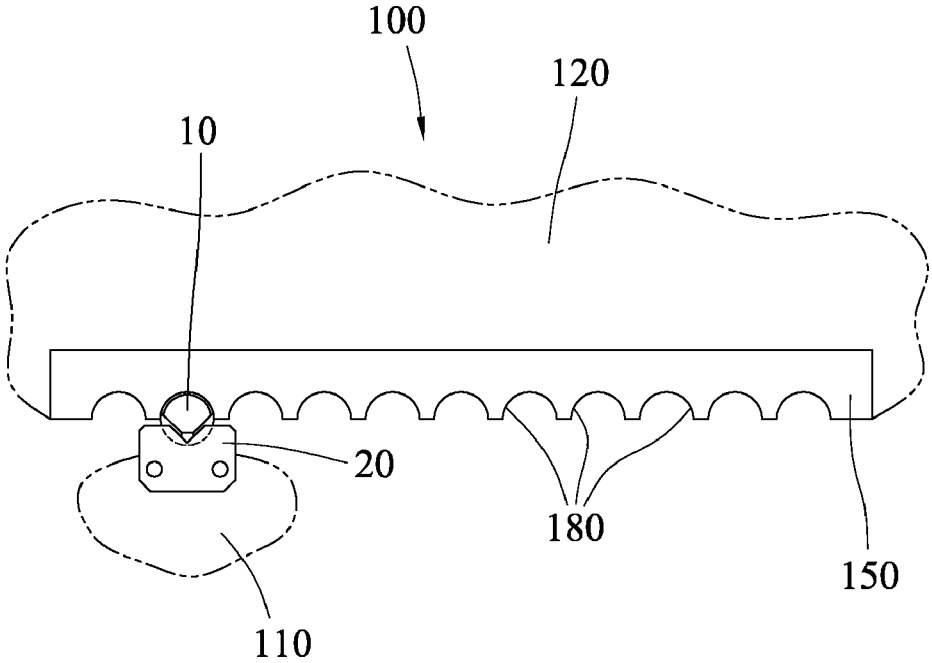
FIG. 3*a* is a front view of the locking assembly of FIG. 1*a*, with the engagement plate locked into a second position.
Figure 3B:
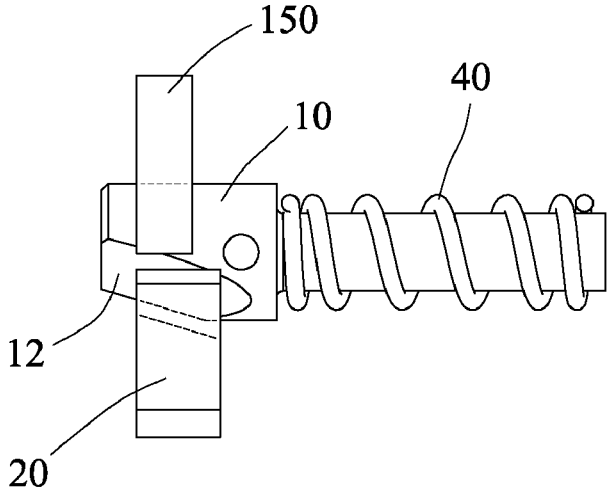
FIG. 3*b* is a side view of the locking assembly of FIG. 3*a*.
Figure 3C:
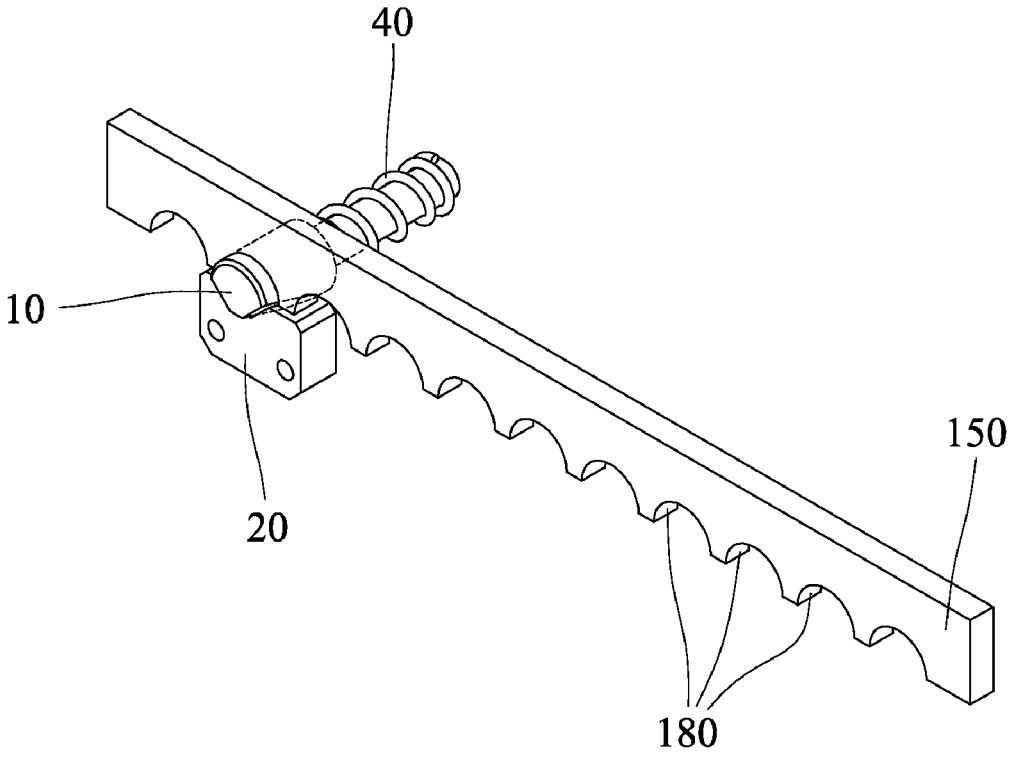
FIG. 3*c* is a perspective view of the locking assembly of FIG. 3*a*.

Referring to FIGS. 3*a*-3*c*, the engagement pin 10 has been aligned with a different engagement surface 180 than the engagement surface 180 that it was aligned with in FIGS. 1*a*-1*c*. The engagement pin 10 has been extended along the axial direction, causing the wedge block 20 to drive the engagement pin 10 upward into the new engagement surface 180. The first body 110 and the second body 120 are again locked in place by the engagement pin 10, but the first body 110 has been relocated to a new position relative to the second body 120.

Figure 4A:
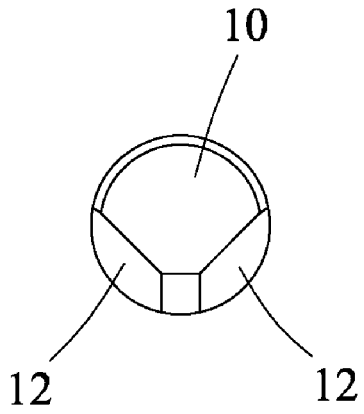
FIG. 4*a* is an end view of a showing one example of an engagement pin.
Figure 4B:
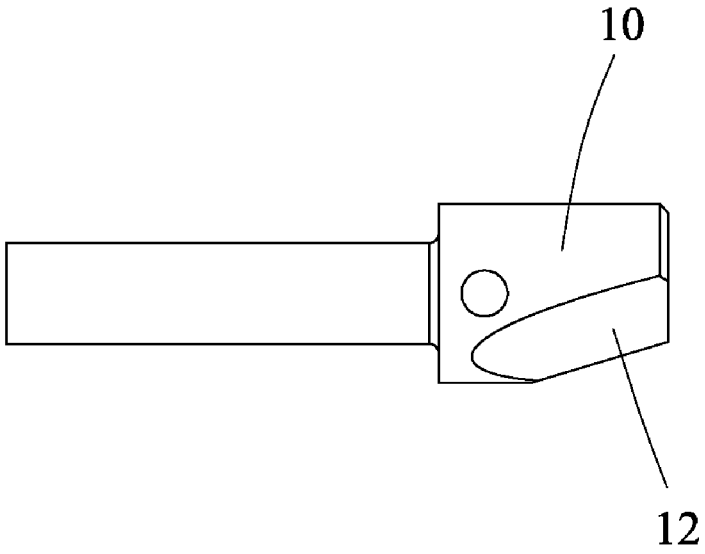
FIG. 4*b* is a side view of the engagement pin of FIG. 1*a*.

Referring to FIGS. 4*a*-4*b*, the engagement pin 10 is shown more clearly with its beveled surfaces 12. This particular embodiment shows two beveled surfaces, but one of ordinary skill in the art will realize that other configurations are possible while remaining within the scope and spirit of the invention.

Figure 5A:
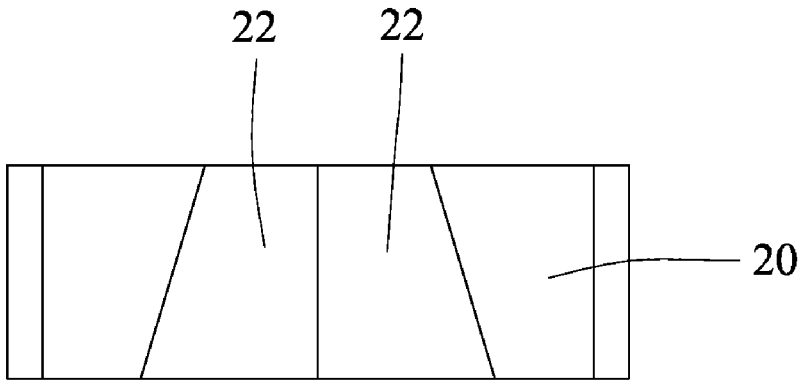
FIG. 5*a* is a top view of a wedge block.
Figure 5B:
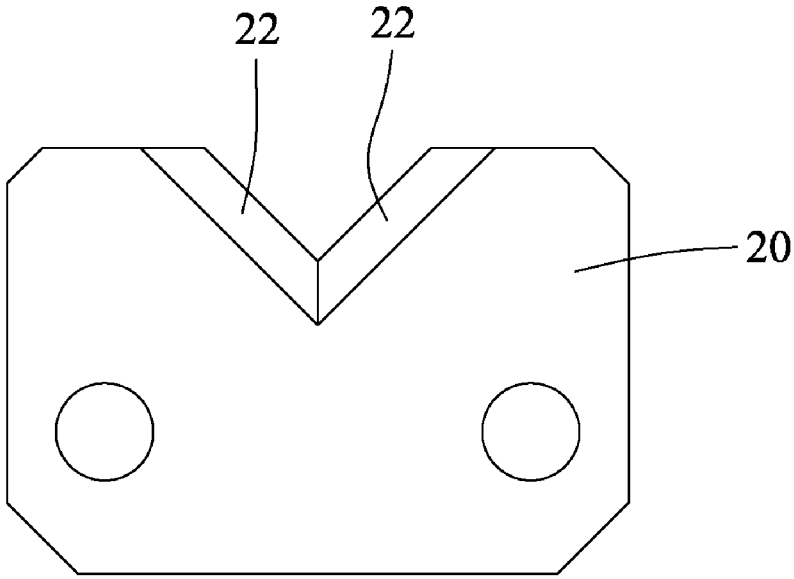
FIG. 5*b* is a front view of the wedge block of FIG. 1*a*.

Referring to FIGS. 5*a*-5*b*, the wedge block 20 is shown more clearly with its inclined guide surfaces 22. It should be noted that a separate wedge block 20 is shown here, but one of ordinary skill in the art will realize that the wedge block 20 does not need to be a separate component. For instance, it would be possible to put the inclined guide surfaces 22 directly into the first body 110, thereby allowing the elimination of the wedge block, while still keeping all of the features and functionality of the present invention.

Figure 6:
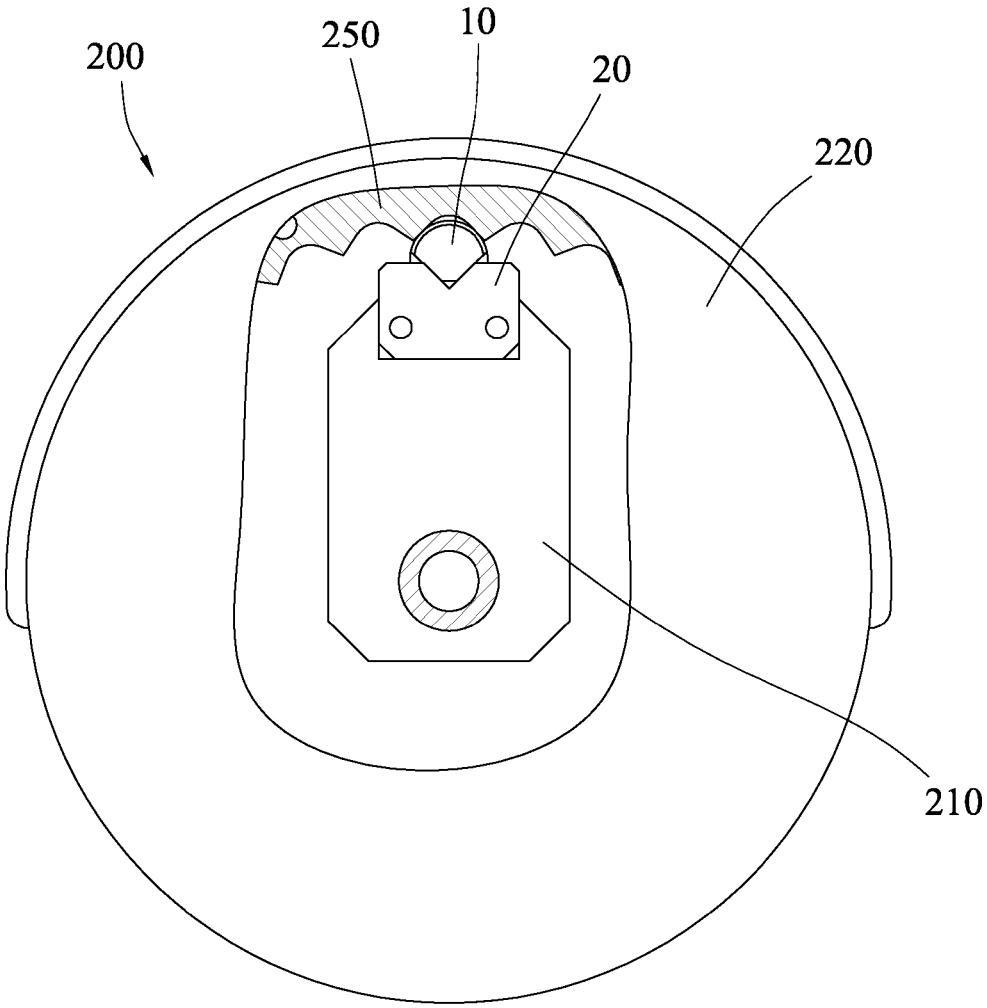
FIG. 6 is a partial cutaway front view of a locking assembly according to a second embodiment of the present invention.

Referring now to FIG. 6, a second embodiment of the present invention is a locking and unlocking apparatus 200 with an engagement pin 10 and a spring 40 (shown in FIG. 8), a first body 210 including a wedge block 20, and a second body 220 including an engagement plate 250 with a plurality of engagement surfaces 280. The first body 110 and the second body 120 are rotatably movable with respect to one another in this embodiment, but other than that, this second embodiment has all of the same features and functionality of the first embodiment.

Figure 7:
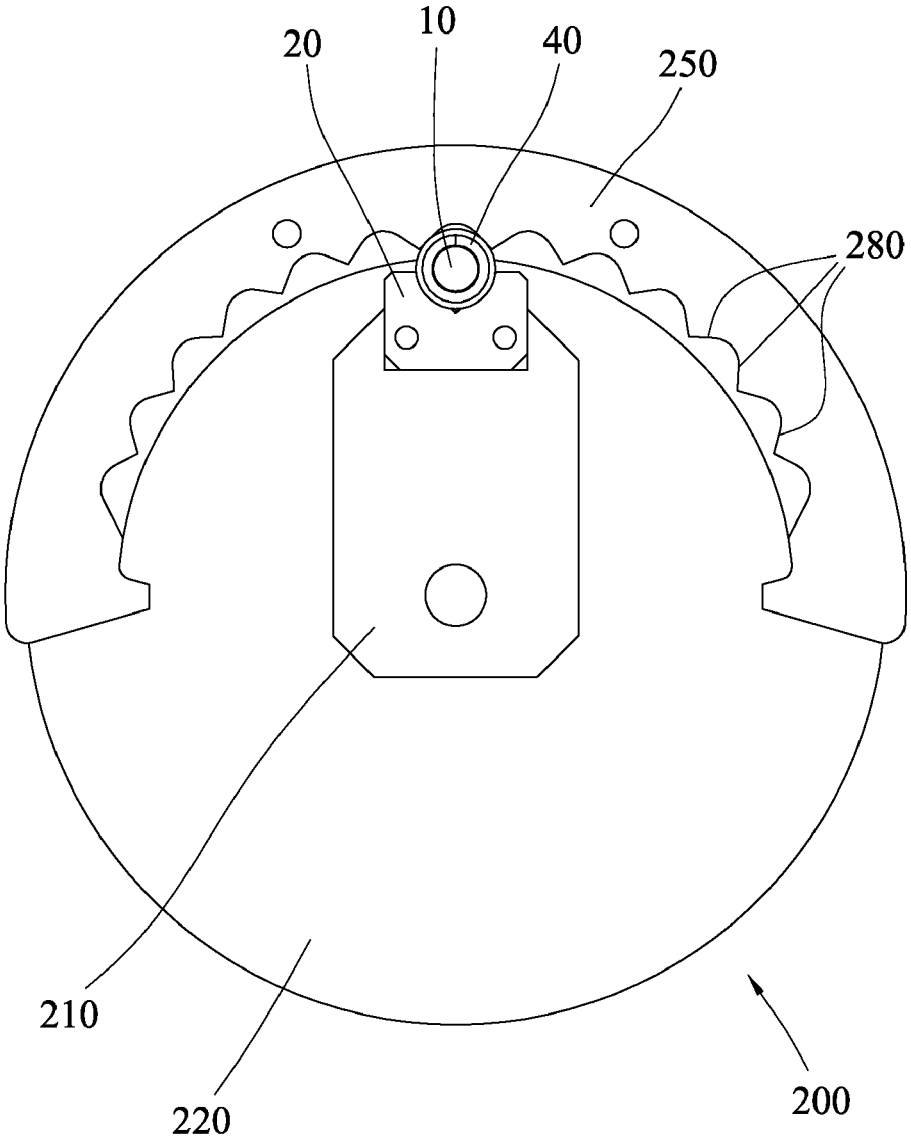
FIG. 7 is a rear view of the locking assembly of FIG. 6.

Referring to FIG. 7, a rear view is shown of the second embodiment of the locking and unlocking apparatus to better show the features. The engagement pin 10 is shown extended and fully engaged with the engagement surfaces 280 of the engagement plate 250. Because of this, the engagement plate 250 is locked in place relative to the wedge block 20.

Figure 8:
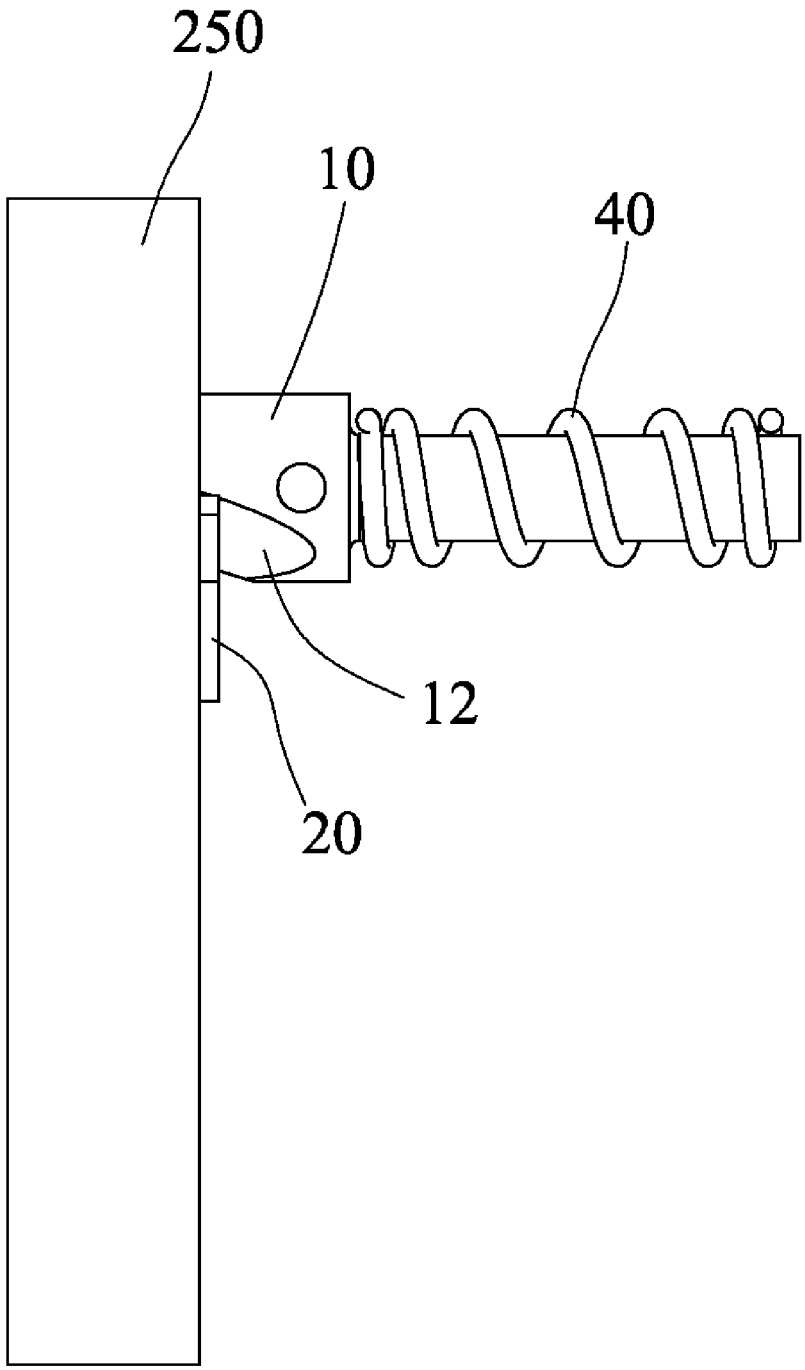
FIG. 8 is a side view of the locking assembly of FIG. 6.

Referring to FIG. 8, a side view is shown of the second embodiment. The engagement pin 10 is shown extended into engagement with the engagement plate 250. The spring 40 biases the engagement pin toward the extended position, and the wedge block 20 drives the engagement pin 10 upward to tightly engage the engagement plate 250.

Figure 9:
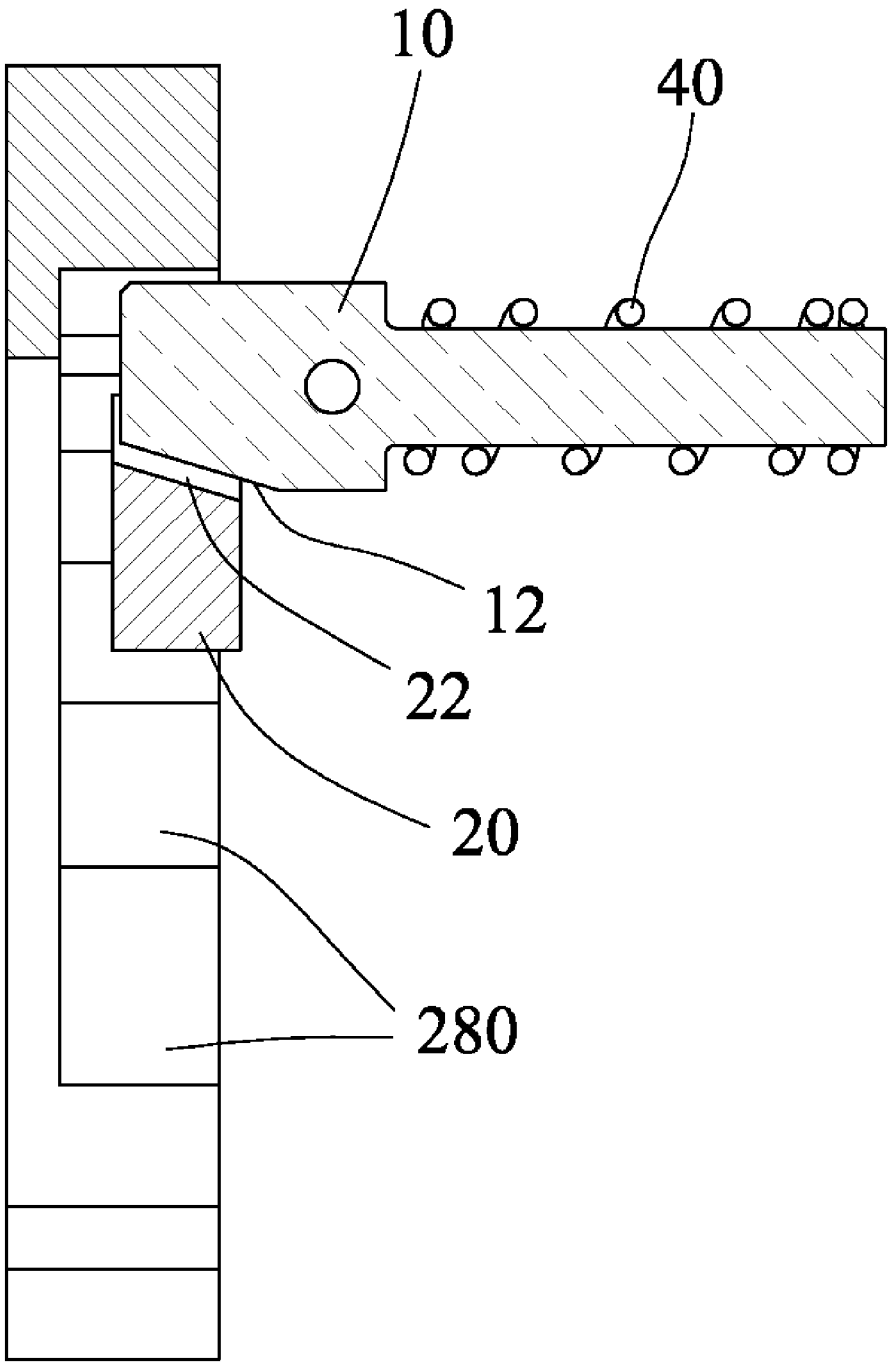
FIG. 9 is a cutaway side view of the locking assembly of FIG. 6.

FIG. 9 is a cross sectional view of the view shown in FIG. 8. The engagement pin 10 is driven upward by the inclined guide surface 22 of the wedge block 20 as the engagement pin 10 is driven axially forward, thereby causing the engagement pin 10 to wedge up into one of the plurality of engagement surfaces 280. Because of this, the engagement plate 250 is locked in place relative to the wedge block 20.

Figure 10:
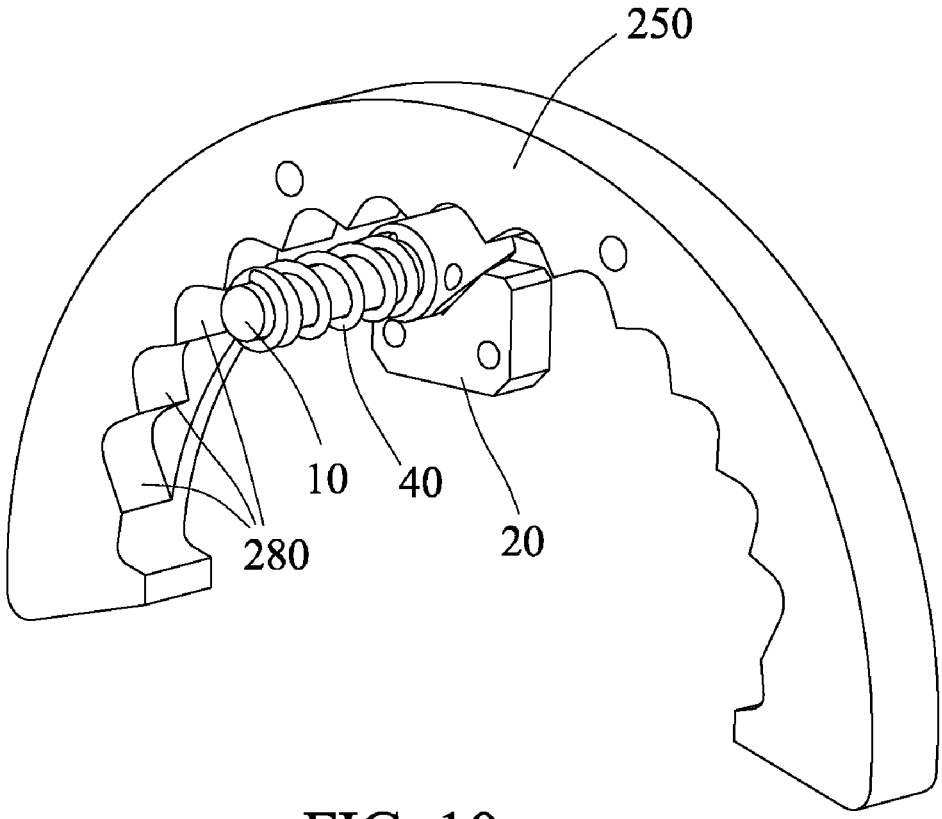
FIG. 10 is a rear perspective view of the locking assembly of FIG. 6.

FIG. 10 is a right rear perspective view to more clearly show where all of the components are interacting with one another.

Figure 11:
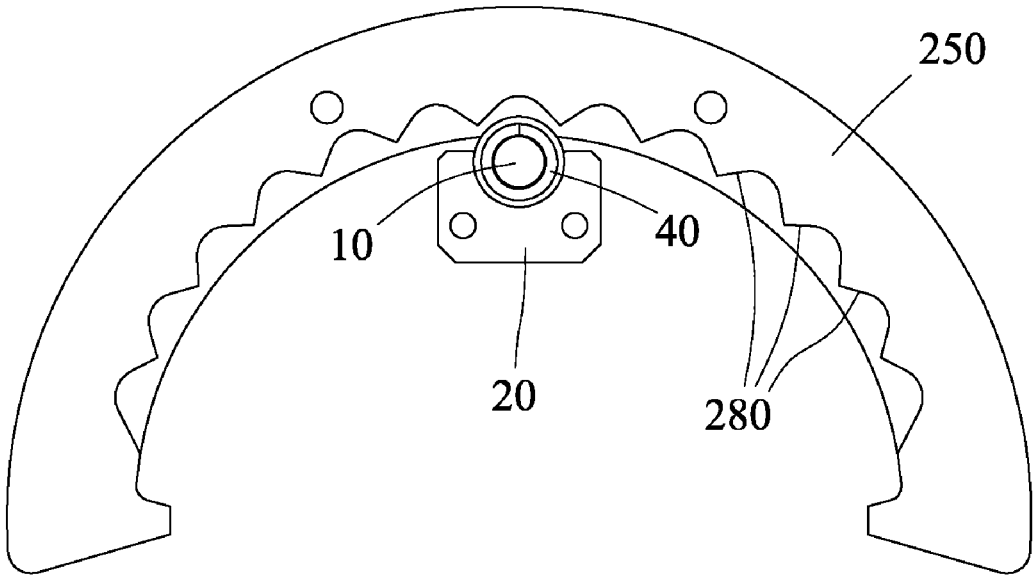
FIG. 11 is a rear view of the locking assembly of FIG. 6, with the engagement pin in the retracted position.

Referring to FIG. 11, this is the same view as FIG. 7, except that the engagement pin 10 has been retracted. The engagement pin 10 no longer contacts the engagement plate 250, allowing the engagement plate 250 to rotate relative to the wedge block 20.

Figure 12:
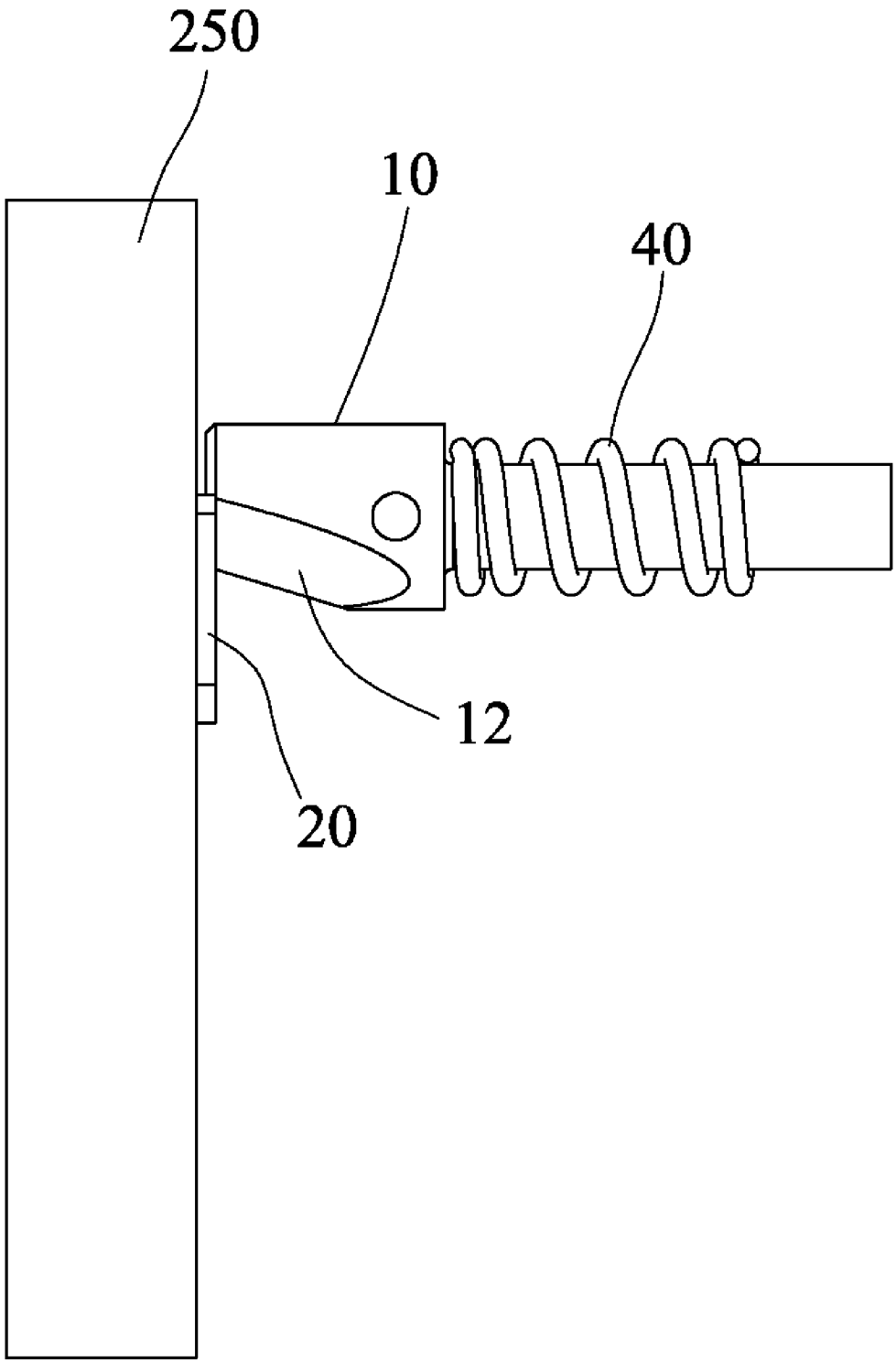
FIG. 12 is a side view of the locking assembly of FIG. 11.

Referring to FIG. 12, a side view shows that the engagement pin 10 has been retracted so that it no longer contacts the engagement plate 250.

Figure 13:
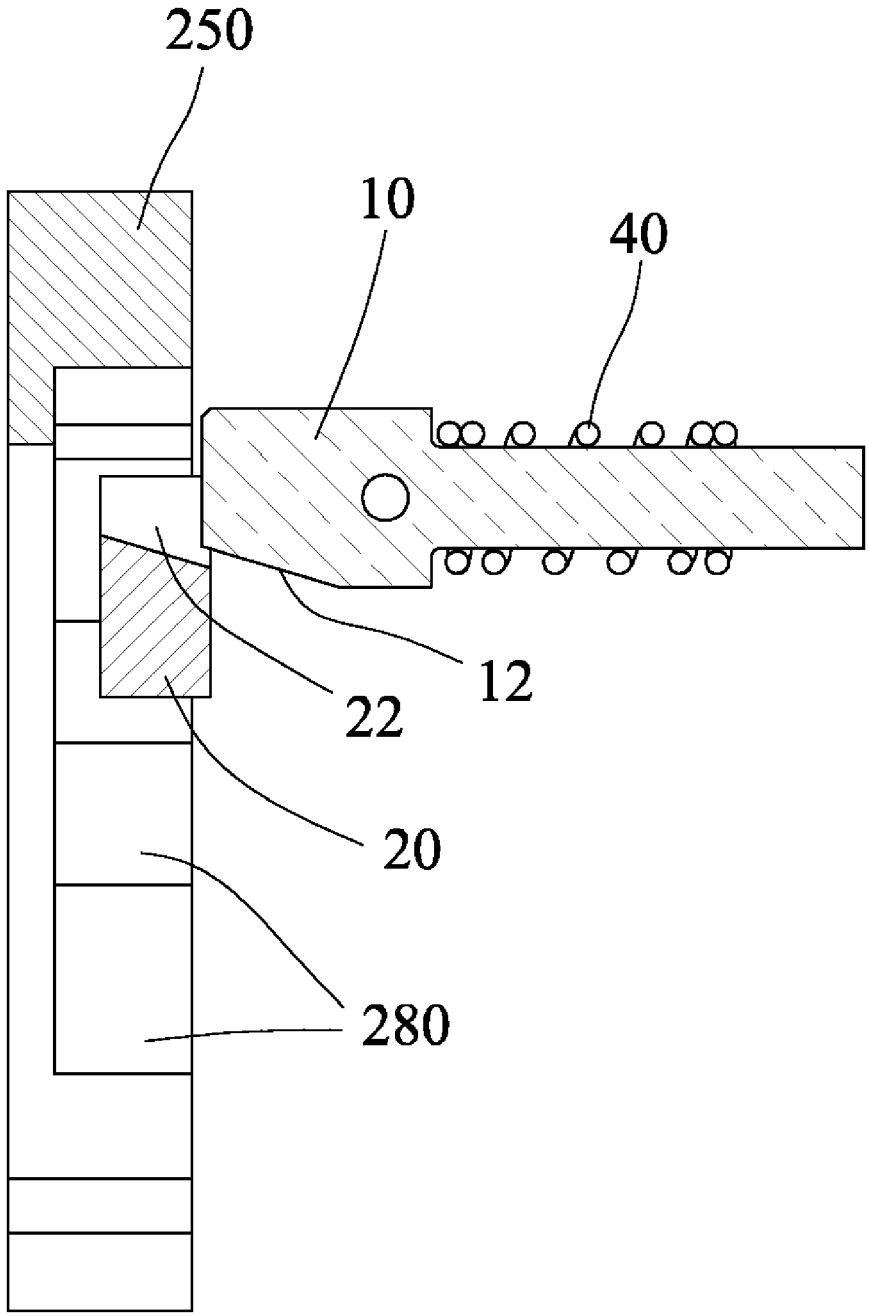
FIG. 13 is a cutaway side view of the locking assembly of FIG. 11.

FIG. 13 is a cross sectional view of the view shown in FIG. 12. The engagement pin 10 has moved down the inclined guide surface 22 of the wedge block 20 as the engagement pin 10 has been retracted, thereby causing the engagement pin 10 to release the engagement plate 250, and allowing the engagement plate 250 to rotate relative to the wedge block 20.

Figure 14:
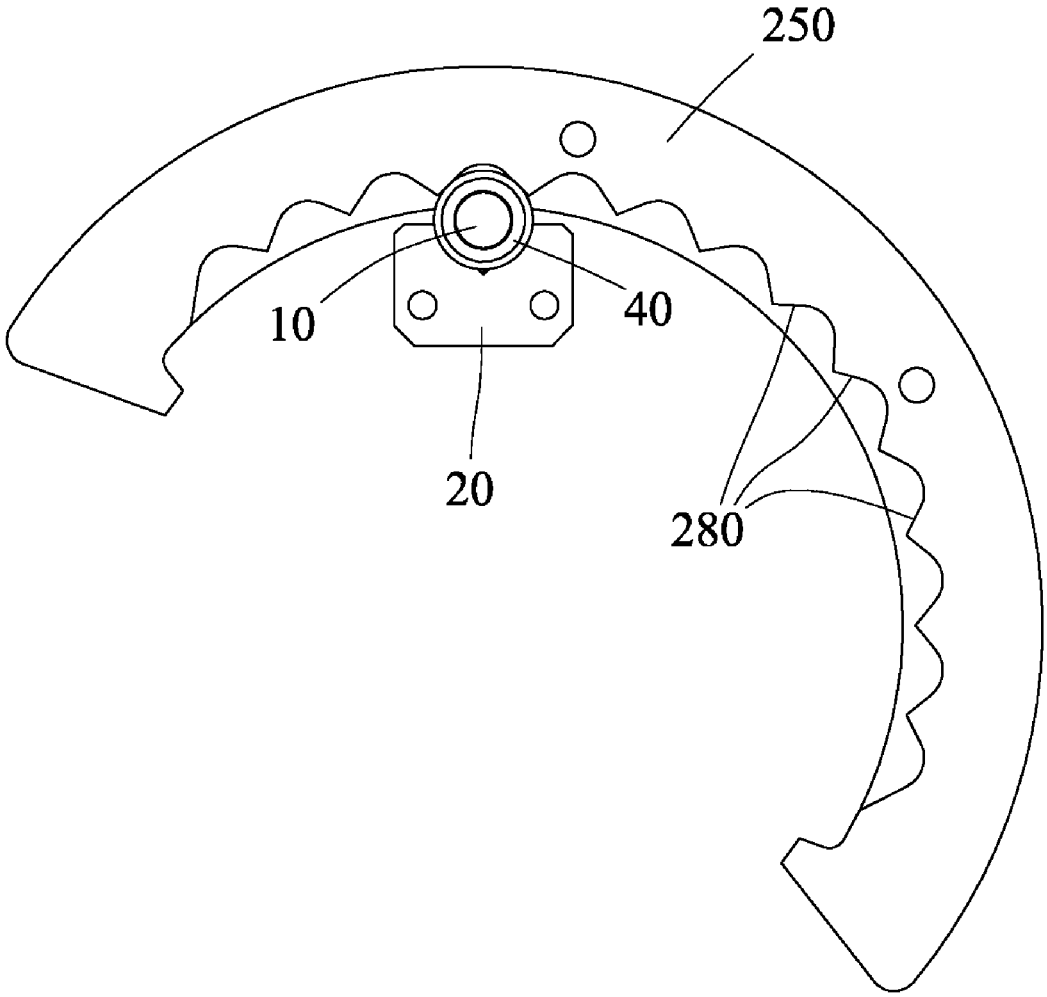
FIG. 14 is a rear view of the locking assembly of FIG. 6, with the engagement plate locked into a second position.
Figure 15:
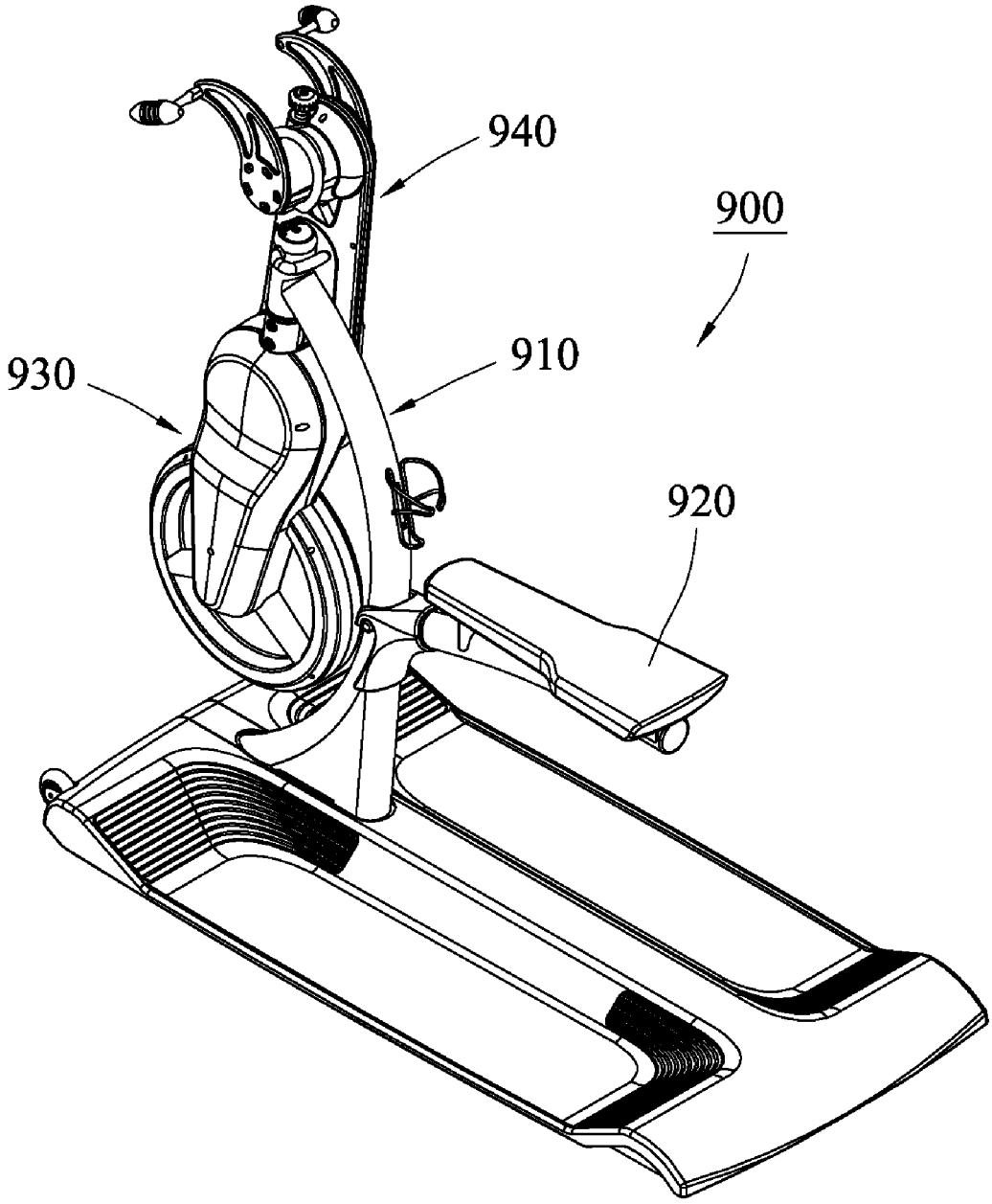
FIG. 15 is a left rear perspective view of an exercise apparatus utilizing the locking mechanism of FIG. 6.

Referring to FIG. 14, this is the same view as FIG. 7, except that the engagement pin 10 has been aligned with a different engagement surface 280 than the engagement surface 280 that it was aligned with in FIG. 7. The engagement pin 10 has been extended along the axial direction, causing the wedge block 20 to drive the engagement pin 10 upward into the new engagement surface 280. The first body 210 and the second body 220 are again locked in place by the engagement pin 10, but the second body 220 has been relocated to a new position relative to the first body 210.

Figure 16:
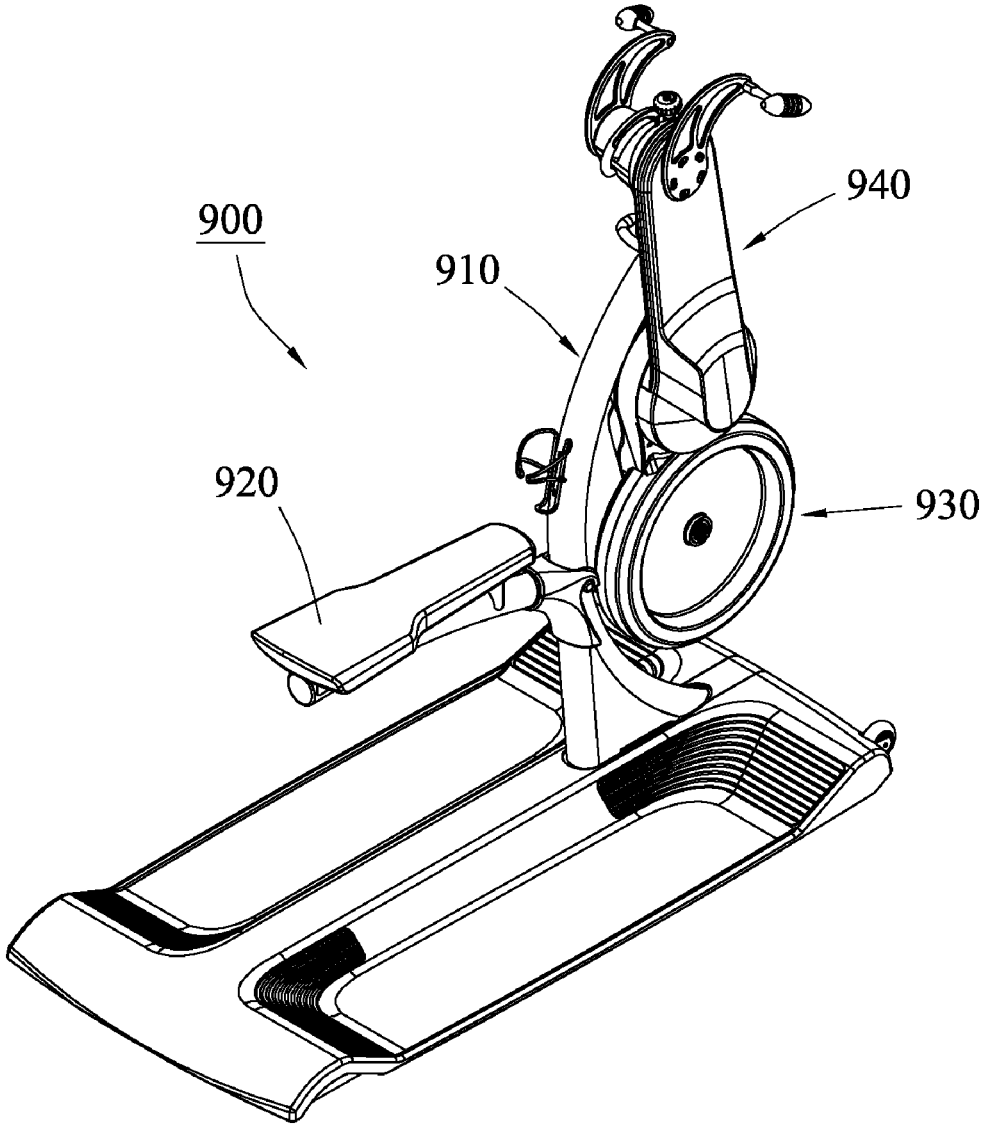
FIG. 16 is a right rear perspective view of the exercise apparatus of FIG. 15.

FIGS. 15-21*b* show an exercise apparatus 900 utilizing the locking mechanism 200 disclosed in FIG. 6. The exercise apparatus 900 of FIG. 15 has a frame structure 910, a seat 920 removably attached to the frame structure 910, a flywheel assembly 930, and a drive system 940 mounted to the frame structure 900 and operably engaged to rotate the flywheel assembly 930. FIG. 16 is another view of the same exercise apparatus 900.

Figure 17:
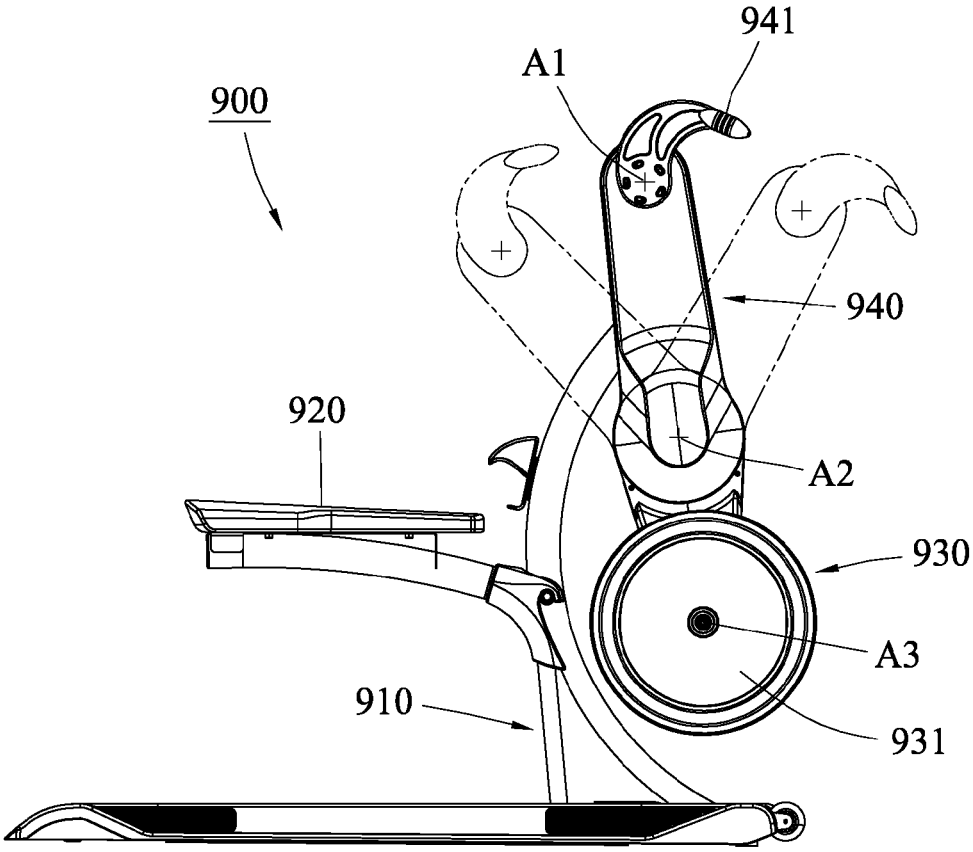
FIG. 17 is a side view of the exercise apparatus of FIG. 15.

FIG. 17 is a side view of the exercise apparatus 900. The drive system 940 has one or more hand cranks 941 pivotally mounted to the drive system 940 at a first axis A1. At least a portion of the drive system 940 is pivotally mounted to the frame structure 910 at a second axis A2, so that a least a portion of the drive system 940 can be rotated about axis A2 to position the hand cranks 941 in a multitude of different locations relative to the user. Rotation of the one or more hand cranks 941 can be transferred by the drive system 940 into a flywheel 931, which rotates about a third axis A3. The flywheel assembly 930 includes the flywheel 931, and may include additional mechanisms (not shown) to add resistance to the rotation of the flywheel 931 or the hand cranks 941.

Figure 18:
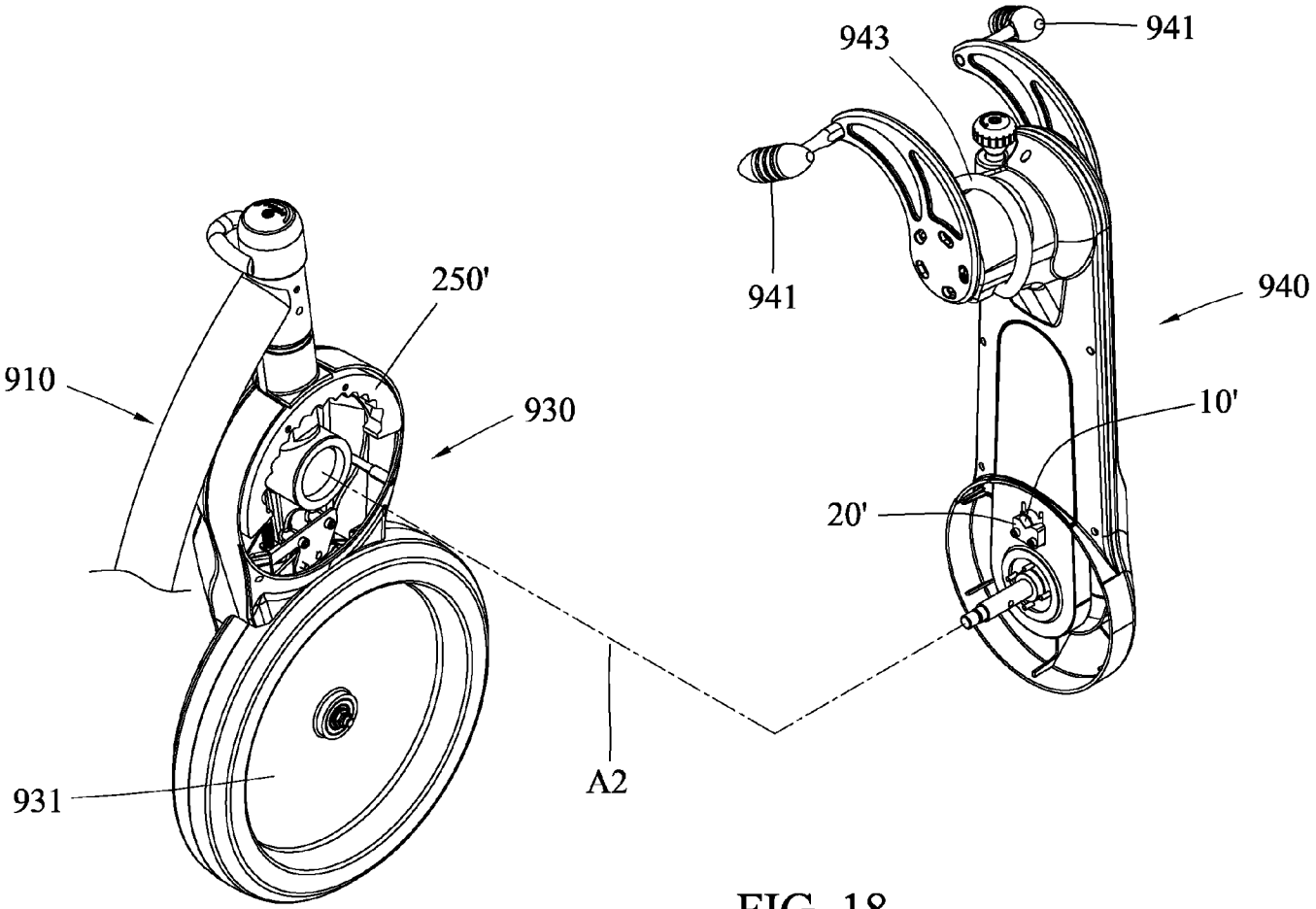
FIG. 18 is a partial exploded view of the exercise apparatus of FIG. 15.

FIG. 18 is a partially exploded view with the drive system 940 broken into two portions. Axis A2 is shown for both portions of the drive system 940. The portion of the drive system 940 shown on the left includes the frame structure 910 and the flywheel assembly 930. This left portion of the drive system 940 is attached to the frame structure 910, and remains station with respect to axis A2. However, it should be noted that the flywheel 931 does rotate about axis A3. This left portion includes an engagement plate 250' with a plurality of engagement surfaces.

The portion of the drive system 940 shown on the right includes the hand cranks 941, and this portion of the drive system 940 is rotatable around axis A2. This right portion includes a wedge block 20', an engagement pin 10', and a control lever 943 for retracting the engagement pin 10'. The engagement pin 10' engages with one of a plurality of engagement surfaces on the engagement plate 250' when the engagement pin 10' is extended, thereby locking the right portion of the drive system 940 into a particular orientation, and preventing rotation of the right portion of the drive system around axis A2. When the control lever 943 is actuated, the engagement pin 10' is retracted out of engagement with the engagement plate 250', thereby allowing the right portion of the drive system 940 to rotate about axis A2.

It is worth noting that an exercise apparatus 900 such as is shown here will have many loads acting on it when a user is exercising by rotating the crank arms 941 around axis A1. Because these loads are changing direction all of the time during the exercise, these loads will tend to rock the drive system 940 back and forth around the pivot axis A2. Because of the large distance between the crank arms 941 and the adjustable pivot axis A2, any small displacements between the engagement pin 10', the wedge block 20', and the engagement plate 250' will be amplified to become large displacements in the position of the crank arms 941. Therefore, it is important that the locking mechanism 200 used in an application such as this exercise apparatus 900 have substantially zero clearance between the various components when in the locked position. The present invention serves to fill this need.

Figure 19:
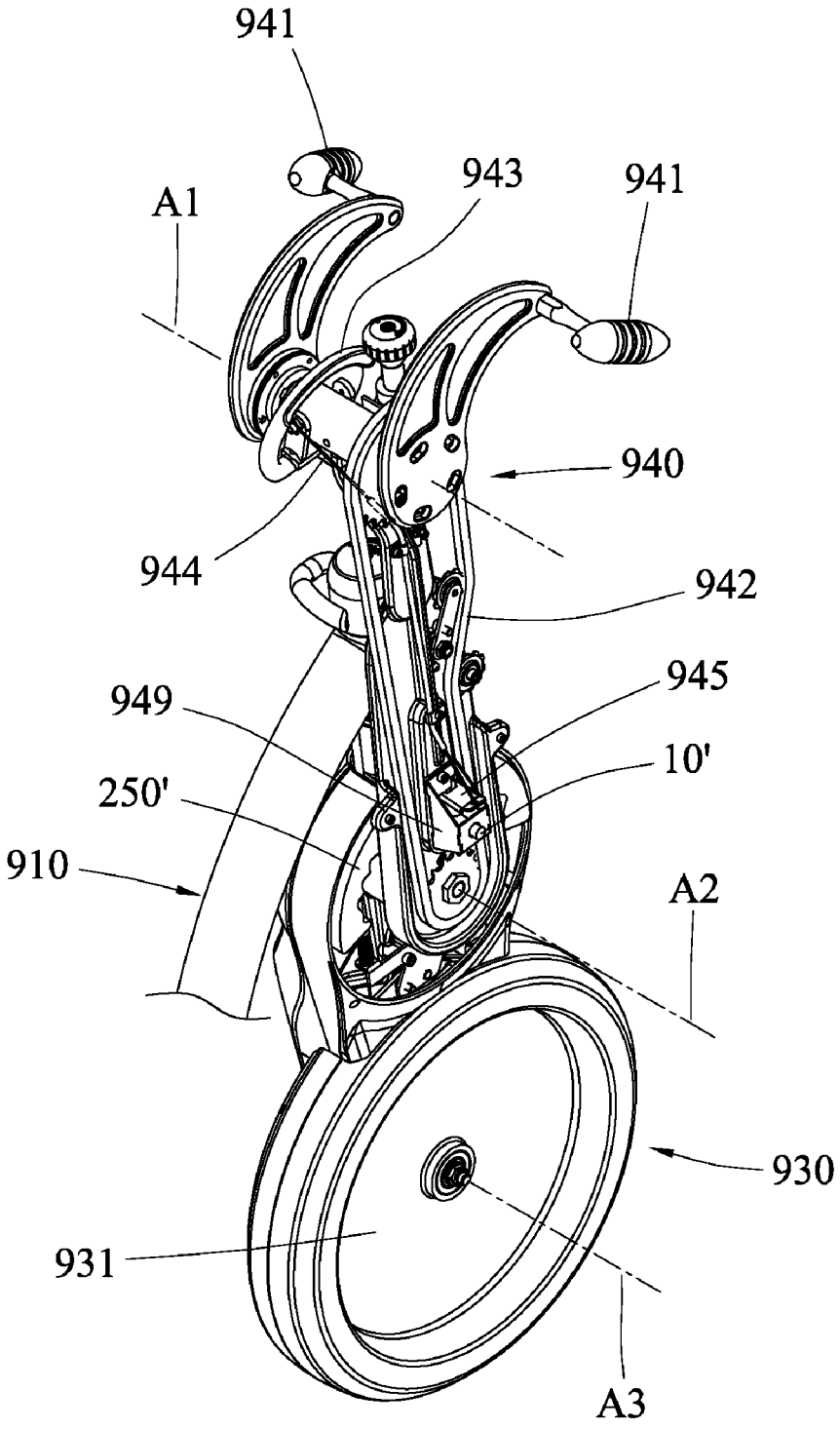
FIG. 19 is a partial perspective view of the exercise apparatus of FIG. 15 with one of the covers removed to show the mechanisms inside.

Referring to FIG. 19, the exercise apparatus 900 has had a cover removed to better show both the exercise apparatus and the operation of the locking mechanism of the present invention. The control lever 943 is connected at a first end to a cable 944. The second end of the cable 944 is connected to a latch piece 945, which is pivotally connected to a pin housing 949. The latch piece 945 is also operably engaged with engagement pin 10' so that pivoting up the back end of the latch piece 945 retracts the engagement pin 10'. When a user pulls on the control lever 943, the cable 944 pulls up on the back end of the latch piece 945, causing the engagement pin 10' to retract. This allows the user to rotate the hand cranks 941 and the drive mechanism 940 into a new position. By releasing the control lever 943, the cable 944 is loosened, allowing the back end of the latch piece 945 to drop down, thereby allowing the engagement pin 10' to extend forward into a new locking position.

The pin housing 949 of FIG. 19 is shown as a low precision metal stamping. This again demonstrates another benefit of the locking mechanism of the present invention. Whereas other locking mechanisms require very tight tolerances to tightly constrain the moving pieces, this locking mechanism does not require tight tolerances. The pin housing 949 in this case does nothing to guide the engagement pin 10' into or out of its locking position. The pin housing 949 merely surrounds the engagement pin 10', and keeps the latch piece 945 operably connected to the engagement pin 10'. Because the engagement pin 10' is free to move in both the axial and transverse directions, the engagement pin 10' locates itself between the wedge block 20' and one of the plurality of engagement surfaces on the engagement plate 250' so that even with very loose tolerances, the engagement pin 10' will self-locate during extension to securely wedge itself between the wedge block 20' and the engagement plate 250'.

Figure 20:
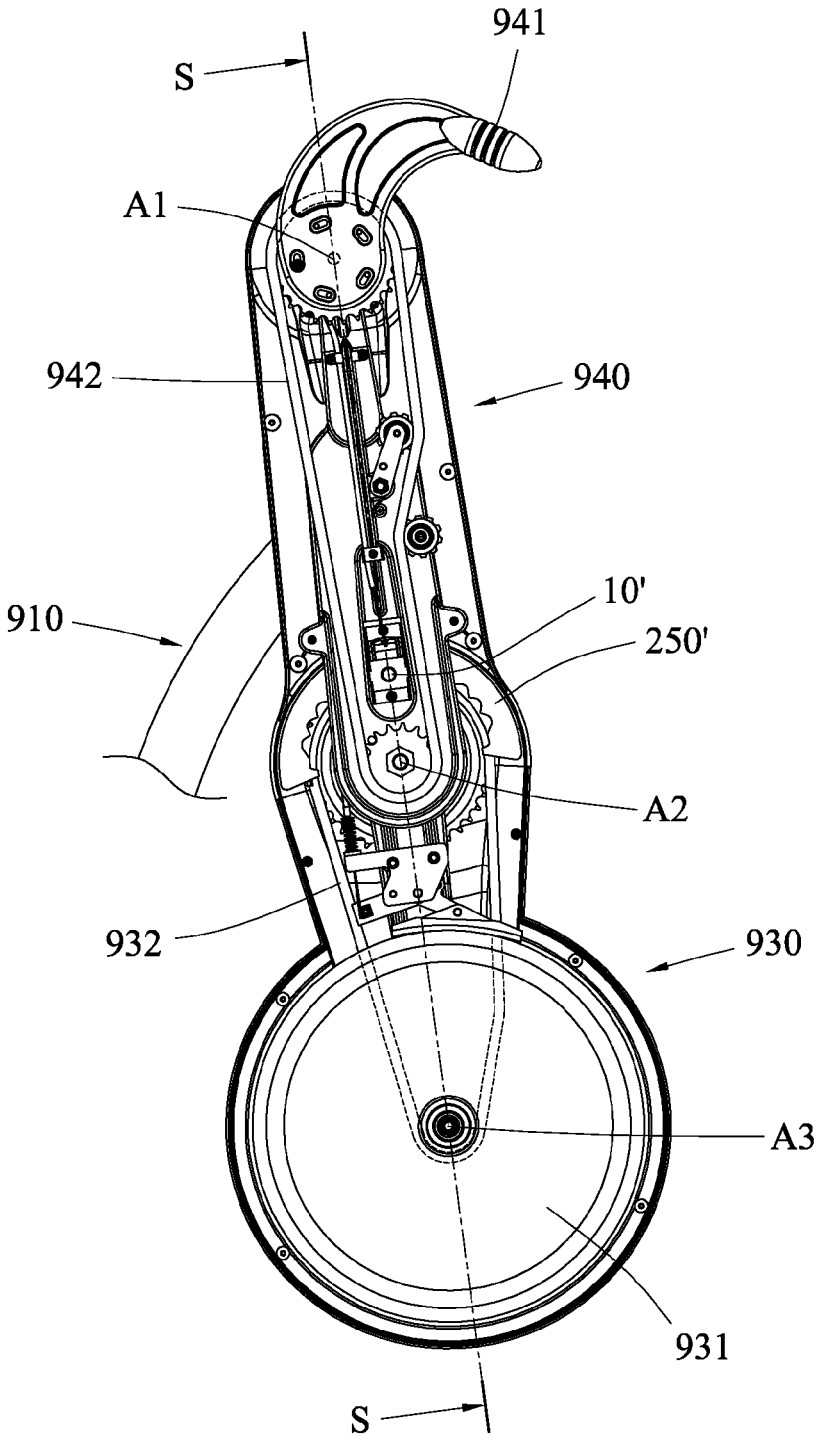
FIG. 20 is a side view of the exercise apparatus of FIG. 19.

FIG. 20 shows a side view of the exercise apparatus 900 to better illustrate the location of the engagement pin 10' in relation to the engagement plate 250'. Also shown is a first chain 942 and a second chain 932 to better illustrate how the hand cranks 941 can be rotated to drive rotation of the flywheel 931 about axis A3.

Figure 21:
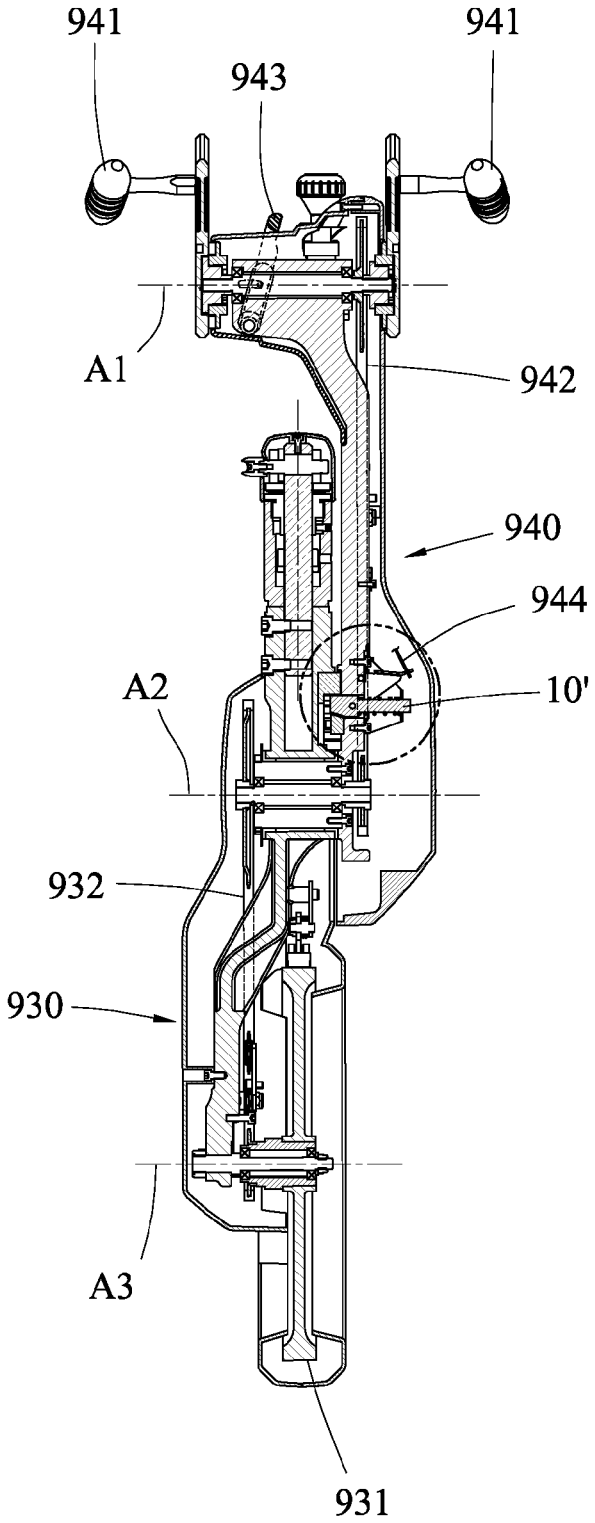
FIG. 21 is section view S-S of the exercise apparatus of FIG. 20.
Figure 21A:
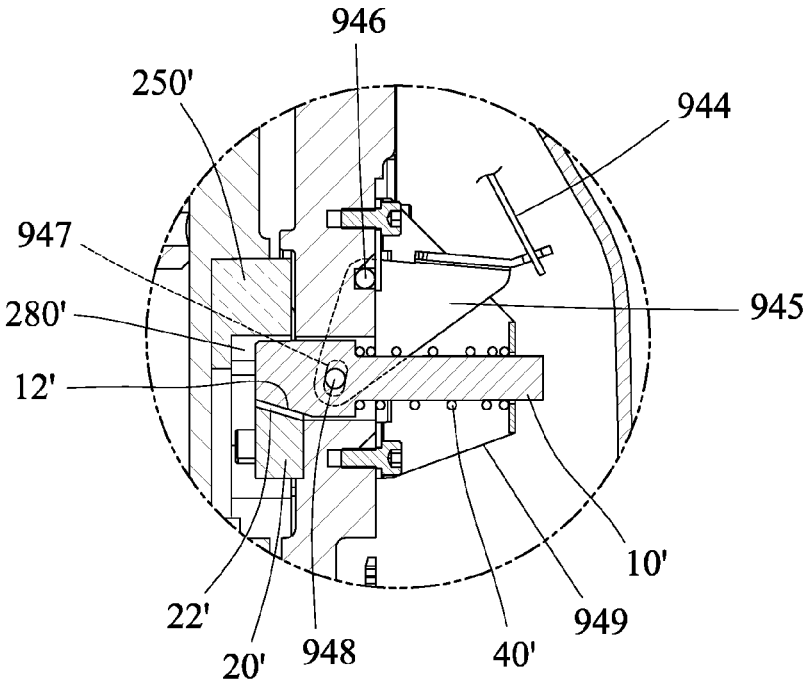
FIG. 21*a* is detail view of the locking mechanism utilized in the exercise apparatus of FIG. 21.
Figure 21B:
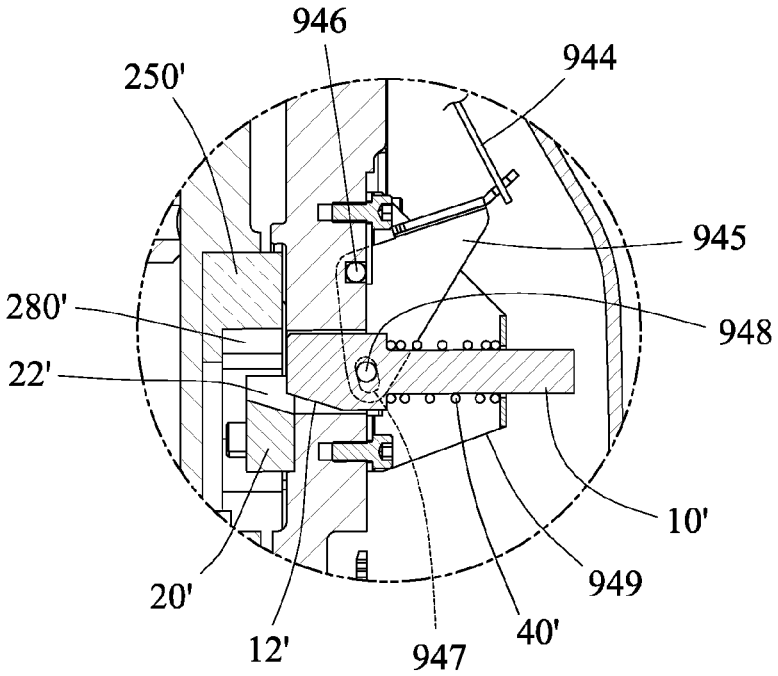
FIG. 21*b* is a second detail view of the locking mechanism of FIG. 21.

Referring to FIGS. 21, 21*a*, and 21*b*, a cross-section of the exercise apparatus 900 illustrates the operation of the engagement pin 10' from another angle. FIGS. 21*a* and 21*b* reveal in more detail how the cable 944 rotates the latch piece 945 about an axle 946, and how a slot 947 within the latch piece 945 engages a cross-pin 948 through the engagement pin 10' to retract the engagement pin 10'. FIG. 21*a* illustrates the engagement pin 10' in its extended position, and FIG. 21*b* illustrates the engagement pin 10' in its retracted position. A coil spring 40' is disposed between the engagement pin 10' and the pin housing 949 to bias the engagement pin 10' into the extended position. During extension into the locked position, the engagement pin 10' has at least one beveled surface 12' that rides up guide surfaces 22', pushing the engagement pin 10' upward in the transverse direction into contact with one of a plurality of engagement surfaces 280'. This self-locates the engagement pin 10' into a wedge position between the wedge block 20' and the engagement plate 250', thereby substantially eliminating relative motion between the wedge block 20' and the engagement plate 250'.

Referring to FIGS. 22*a*-22*b* and FIGS. 23*a*-23*b*, we can compare some of the differences between the present invention and the standard pull pin.

Figure 22A:
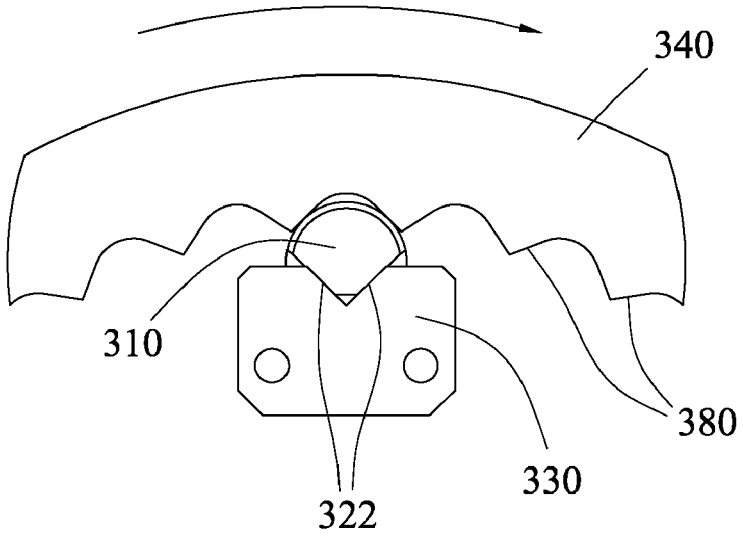
FIG. 22*a* is a partial front view of the locking assembly of FIG. 6.

Referring to FIG. 22*a*, an engagement pin 310 is shown fully engaged with the inclined guide surfaces 322 on the first body 330 and with one of a plurality of engagement surfaces 380 on the second body 340. Assuming that the first body 330 is stationary and assuming that the second body 340 is being torqued in a clockwise direction, we can graphically show how the shear forces would act on the engagement pin.

Figure 22B:
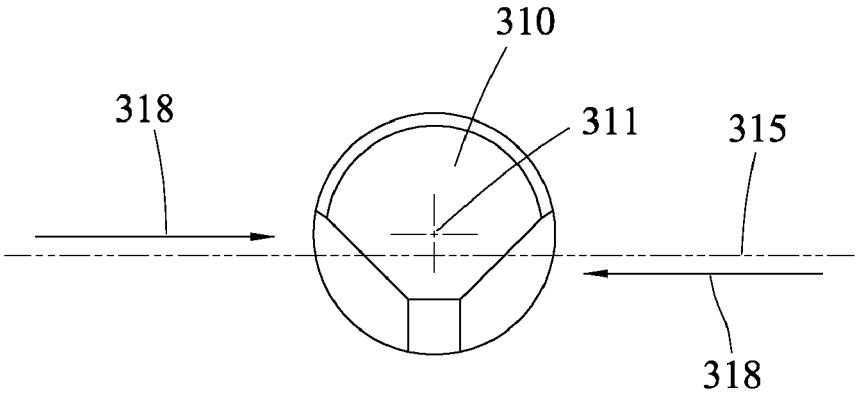
FIG. 22*b* is a front view of the engagement pin of FIG. 22*a*.

Referring to FIG. 22*b*, the engagement pin 310 is shown with an axis 311 perpendicular to the plane of the page (perpendicular to the cross-section shown, such that the axis is coming out of the page), and a shear plane 315 parallel to the axis 311. Shear forces 318 are shown on either side of the shear plane 315. This is very different from how shear forces develop in a standard pull pin.

Figure 23A:
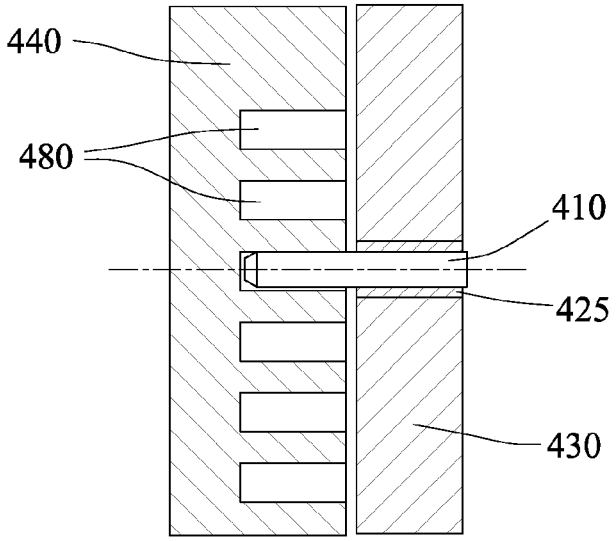
FIG. 23*a* is a front view of a locking assembly using pull pin.

Referring to FIG. 23*a*, a standard pull-pin locking assembly is shown. The pull pin 410 needs to be constrained to move only in the axial direction, so it is surrounded by a bushing 425 which allows the pull pin 410 to slide back and forth in the axial direction, but which prevents the pull-pin 410 from moving in any direction perpendicular to the axial direction. This requires very tight diameter tolerances on the inside diameter of the bushing 425 and on the outside diameter of the pull pin 410. Additionally, the bushing must be pressed into the first body 430, which again requires very tight diameter tolerances on the outside diameter of the bushing 425 and on the inside diameter of the first body 430.

The engagement holes 480 in the second body 440 must be size large enough to ensure that the pull pin 410 will always align with the engagement holes 480, and to ensure that the inner diameter of the engagement holes 480 will always be larger than the outer diameter of the pull pin 410. Due to a stack up of tolerances, this requires that the engagement holes 480 are always oversized. When the pull pin 410 is inserted into an oversized engagement hole 480, there will always be some clearance around the pull pin 410, so that there will always be some amount of relative motion between the first body 430 and the second body 440. Because of this, a standard pull pin locking assembly always forces one to choose between a relatively inexpensive mechanism which allows relative motion between the components that are supposedly "locked" together, or spending more and more money in an attempt to get tighter tolerances so that the relative motion between the components can be reduced to an acceptable level.

Figure 23B:
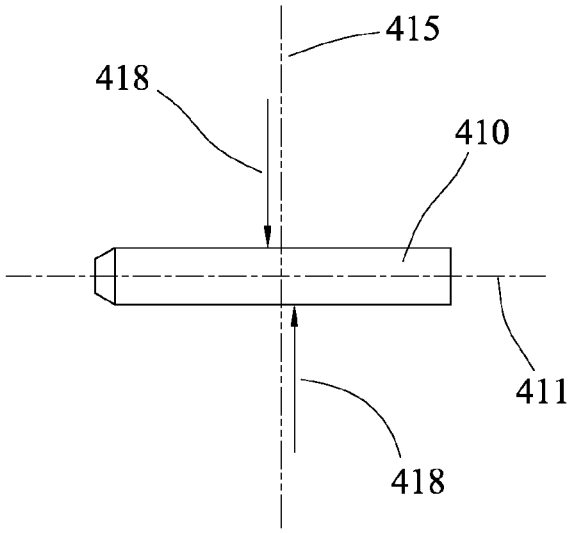
FIG. 23*b* is a side view of the pull pin of FIG. 23*a*.

Referring to FIG. 23*b*, the pull pin 410 is shown with an axis 411, and a shear plane 415 that is perpendicular to the axis 411. Shear forces 418 are shown on either side of the shear plane 415. This is very different from how shear forces develop in an engagement pin 10 of the present invention.

While the present invention has been described in terms of certain preferred embodiments, one of ordinary skill in the art of the invention will recognize that additions, deletions, substitutions, modifications and improvements can be made while remaining within the scope and spirit of the invention as defined by the attached claims.

The invention claimed is:

1. A locking apparatus comprising:

(a) a first body having at least one guide surface;

(b) an engagement pin having a longitudinal axis and having one or more beveled surfaces wherein the one or more beveled surfaces of the engagement pin are slidingly engaged with the guide surface, the guide surface of the first body being inclined with respect to the longitudinal axis of the engagement pin, the engagement pin being movable along the guide surface such that the guide surface drives the engagement pin to move with respect to the first body in a transverse direction orthogonal to the longitudinal axis as the engagement pin moves in an axial direction;

(c) a second body proximate to the first body, the second body having a plurality of engagement surfaces positioned to be substantially aligned with the engagement pin, wherein the first body and second body are movable in relation to one another when the engagement pin is retracted, and wherein the first body and second body can be locked into one of a plurality of relative positions when the engagement pin is extended into one of the plurality of engagement surfaces, and wherein the extended engagement pin tightly engages both the first body and one engagement surface on the second body to substantially eliminate any relative motion between the first body and the second body.

2. An apparatus, as recited in claim 1, wherein the second body is slidingly coupled to the first body.

3. An apparatus, as recited in claim 1, wherein the second body is rotatably coupled to the first body.

4. An apparatus, as recited in claim 1, wherein the second body is rotatably movable with respect to the first body, and wherein the plurality of engagement surfaces are arranged along an arc such that, as the second body is rotated with respect to the first body, each engagement surface rotates to be substantially aligned with the engagement pin.

5. An apparatus, as recited in claim 1, wherein the first body is rotatably movable with respect to the second body, and wherein the plurality of engagement surfaces are arranged along an arc such that, as the first body is rotated with respect to the second body, the engagement pin rotates along the arc of the engagement surfaces so as to be substantially aligned with each of the engagement surfaces in turn.

6. An apparatus, as recited in claim 1, further comprising a spring to bias the engagement pin toward an extended position, wherein the spring will drive the engagement pin to automatically engage with any one of the plurality of engagement surfaces that are substantially aligned with the engagement pin.

7. An apparatus, as recited in claim 1, wherein loads applied to the engagement pin by the guide surface and by the engagement surface create transverse shear forces within the engagement pin acting in a plane parallel to the axis.

8. A locking apparatus comprising:

(a) a frame;

(b) a wedge block fixed to the frame and having at least one guide surface;

(c) an engagement pin having a longitudinal axis and having one or more beveled surfaces wherein the one or more beveled surfaces of the engagement pin are slidingly engaged with the guide surface of the wedge block, the guide surface of the wedge block being inclined with respect to the longitudinal axis of the engagement pin, the engagement pin being movable along the guide surface such that the wedge block drives the engagement pin to move with respect to the frame in a transverse direction orthogonal to the longitudinal axis as the engagement pin moves in an axial direction;

(d) an engagement plate having a plurality of engagement surfaces positioned to be substantially aligned with the engagement pin, wherein the engagement plate is movable in relation to the frame when the engagement pin is retracted, and wherein the engagement plate can be locked into one of a plurality of relative positions when the engagement pin is extended into one of the plurality of engagement surfaces, and wherein the extended engagement pin tightly engages both the wedge block and one engagement surface on the engagement plate to substantially eliminate any relative motion between the engagement plate and the frame.

9. An apparatus, as recited in claim 8, wherein the engagement plate is slidingly coupled to the frame.

10. An apparatus, as recited in claim 8, wherein the engagement plate is rotatably coupled to the frame.

11. An apparatus, as recited in claim 8, wherein the engagement plate is rotatably movable with respect to the frame, and wherein the plurality of engagement surfaces are arranged along an arc such that, as the engagement plate is rotated with respect to the frame, each engagement surface rotates to be substantially aligned with the engagement pin.

12. An apparatus, as recited in claim 10, wherein the frame is rotatably movable with respect to the engagement plate, and wherein the plurality of engagement surfaces are arranged along an arc such that, as the frame is rotated with respect to the engagement plate, the engagement pin rotates along the arc of the engagement surfaces so as to be substantially aligned with each of the engagement surfaces in turn.

13. An apparatus, as recited in claim 8, further comprising a spring to bias the engagement pin toward an extended position, wherein the spring will drive the engagement pin to automatically engage with any one of the plurality of engagement surfaces that are substantially aligned with the engagement pin.

14. An apparatus, as recited in claim 8, wherein loads applied to the engagement pin by the wedge block and by the engagement surface create transverse shear forces within the engagement pin acting in a plane parallel to the axis.

15. A locking apparatus comprising:

(a) a first body;

(b) a wedge block fixed to the first body and having at least one guide surface;

(c) an engagement pin having a longitudinal axis and having one or more beveled surfaces wherein the one or more beveled surfaces of the engagement pin are slidingly engaged with the guide surface of the wedge block, the guide surface of the wedge block being inclined with respect to the longitudinal axis of the engagement pin, the engagement pin being movable along the guide surface such that the wedge block drives the engagement pin to move with respect to the first body in a transverse direction orthogonal to the longitudinal axis as the engagement pin moves in an axial direction;

(d) a second body proximate to the first body, the second body having a plurality of engagement surfaces positioned to be substantially aligned with the engagement pin, wherein the first body and second body are movable in relation to one another when the engagement pin is retracted, and wherein the first body and second body can be locked into one of a plurality of relative positions when the engagement pin is extended into one of the plurality of engagement surfaces, and wherein the extended engagement pin tightly engages both the wedge block and one engagement surface on the second body to substantially eliminate any relative motion between the first body and the second body.

16. An apparatus, as recited in claim 15, wherein the second body is rotatably movable with respect to the first body, and wherein the plurality of engagement surfaces are arranged along an arc such that, as the second body is rotated with respect to the first body, each engagement surface rotates to be substantially aligned with the engagement pin.

17. An apparatus, as recited in claim 15, wherein the first body is rotatably movable with respect to the second body, and wherein the plurality of engagement surfaces are arranged along an arc such that, as the first body is rotated with respect to the second body, the engagement pin rotates along the arc of the engagement surfaces so as to be substantially aligned with each of the engagement surfaces in turn.

18. An apparatus, as recited in claim 15, further comprising a spring to bias the engagement pin toward an extended position, wherein the spring will drive the engagement pin to automatically engage with any one of the plurality of engagement surfaces that are substantially aligned with the engagement pin.

19. An apparatus, as recited in claim 15, wherein loads applied to the engagement pin by the wedge block and by the engagement surface create transverse shear forces within the engagement pin acting in a plane parallel to the axis.

20. An exercise apparatus with latch comprising:

(a) a frame structure adapted to be positioned on a surface;

(b) a first body having at least one guide surface and being movably coupled to the frame structure;

(c) a second body coupled to the frame structure and having a plurality of engagement surfaces, one portion of the first body being proximate and movable relative to the plurality of engagement surfaces of the second body;

(d) an engagement pin having a longitudinal axis and having at least one beveled surface wherein the at least one beveled surface of the engagement pin is slidingly engaged with the guide surface, the guide surface of the first body being inclined with respect to the longitudinal axis of the engagement pin, the engagement pin being movable along the guide surface and being movable with respect to the first body in a transverse direction orthogonal to the longitudinal axis as the engagement pin moves axially;

(e) an actuating member coupled between the engagement pin and the first body to direct the engagement pin between a first position and a second position wherein a transverse gap between the engagement pin and one of the plurality of engagement surfaces of the second body is eliminated when the engagement pin is moved from the first position to the second position along the guide surface; and (f) a pair of cranks movably coupled to the first body or the second body, whereby there is substantially no relative motion between the first body and second body when the engagement pin is at the second position and the cranks are being operated.

21. The exercise apparatus with latch of claim 20, wherein the inclined guide surface is with respect to the longitudinal axis of the engagement pin and the beveled surface of the engagement pin is beveled correspondingly.

22. The exercise apparatus with latch of claim 20, wherein the actuating member is pivoted to the first body and the engagement pin is transversely movably coupled to the actuating member.

* * * * *